US009322615B2

(12) United States Patent
Raybman

(10) Patent No.: US 9,322,615 B2
(45) Date of Patent: Apr. 26, 2016

(54) LOW PROFILE FOLDING FRONT AND REAR FIREARM SIGHTS

(71) Applicant: Sig Sauer, Inc., Newington, NH (US)

(72) Inventor: Peter Raybman, West Roxbury, MA (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/595,441

(22) Filed: Jan. 13, 2015

(65) Prior Publication Data

US 2015/0198414 A1 Jul. 16, 2015

Related U.S. Application Data

(60) Provisional application No. 61/926,929, filed on Jan. 13, 2014.

(51) Int. Cl.
*F41G 1/22* (2006.01)
*F41G 1/17* (2006.01)
(Continued)

(52) U.S. Cl.
CPC .. *F41G 1/22* (2013.01); *F41G 1/17* (2013.01); *F41G 11/007* (2013.01); *F41G 1/18* (2013.01); *F41G 11/003* (2013.01)

(58) Field of Classification Search
CPC ..... F41G 1/06; F41G 1/16; F41G 1/17; Y10T 16/5387; Y10T 16/54028; Y10T 16/540254; Y10T 16/540255; Y10T 16/540256; Y10T 16/540257; Y10T 16/5398; Y10T 16/53984; Y10T 16/53985; E05D 2011/1035; E05D 11/10; E05D 11/1007; E05D 11/1028; E05D 11/1042; E05D 11/1078
USPC ..... 42/11
See application file for complete search history.

(56) References Cited

U.S. PATENT DOCUMENTS 5,533,292 A 7/1996 Swan
5,577,326 A * 11/1996 Montelin ..... F41G 1/16 356/251

(Continued)

FOREIGN PATENT DOCUMENTS

DE 102007005142 A1 * 8/2008 ..... F41G 1/22

OTHER PUBLICATIONS

Knight's Armament Product Catalog, Military Weapons, downloaded from http://www.knightarmco.com/military/?term=sights-military, retrieved on Mar. 30, 2015, 3 pages.

(Continued)

*Primary Examiner* — Troy Chambers
*Assistant Examiner* — Joshua Semick
(74) *Attorney, Agent, or Firm* — Finch & Maloney PLLC

(57) ABSTRACT

Low profile folding front and rear firearm sights are disclosed. The firearm sights can be assemblies including a base, an arm, and a sight attached to the arm. The sight assemblies can also include a spring-loaded pivot pin configured to pivotally couple the arm to the base. The sight assemblies can also include a linking pin connecting the pivot and the arm. The linking pin may be inserted into the pivot pin, such that a longitudinal axis of the linking pin intersects a rotational axis of the pivot pin. The sight assemblies can also include a bushing that includes one or more slots (e.g., locking slots and/or detent slots) and is non-permanently attached to the base. The spring-loaded pivot pin can force the linking pin into the at least one bushing slot when the arm is in a deployed and/or folded (stowed) position.

20 Claims, 19 Drawing Sheets

(51) Int. Cl.
*F41G 11/00* (2006.01)
*F41G 1/18* (2006.01)

(56) References Cited

U.S. PATENT DOCUMENTS

| | | | | |
|---|---|---|---|---|
| 5,600,868 | A * | 2/1997 | Tourville et al. | 16/277 |
| 6,732,467 | B1 * | 5/2004 | Luth | F41G 1/16 42/138 |
| 6,779,290 | B1 * | 8/2004 | Houtsma | F41G 1/08 42/111 |
| 7,076,907 | B2 | 7/2006 | Nesseth et al. | |
| D526,380 | S | 8/2006 | Swan | |
| 7,356,962 | B2 | 4/2008 | Swan | |
| D635,634 | S | 4/2011 | Swan | |
| D637,261 | S | 5/2011 | Swan | |
| 7,946,074 | B2 * | 5/2011 | Nemec | 42/137 |
| 8,015,744 | B1 | 9/2011 | Swan | |
| D657,013 | S | 4/2012 | Swan | |
| D666,689 | S | 9/2012 | Swan | |
| D672,422 | S | 12/2012 | Swan | |
| 8,375,619 | B2 * | 2/2013 | Hewes | F41G 1/033 42/136 |
| 8,984,797 | B2 * | 3/2015 | Ballard | F41G 1/00 42/111 |
| 9,062,931 | B2 * | 6/2015 | Troy | F41G 1/08 1/1 |
| 2003/0140546 | A1 | 7/2003 | Kay | |
| 2011/0296734 | A1 | 12/2011 | Troy | |
| 2012/0317860 | A1 * | 12/2012 | Langevin | F41G 1/033 42/111 |

OTHER PUBLICATIONS

Samson Product Catalog, Sights, downloaded from https://www.samson-mfg.com/category/SIGHTS.html, retrieved on Mar. 30, 2015, 3 pages.

Hodge Tool Co., Inc., Industries website page, downloaded from https://www.hodgetool.com/industries.php, retrieved on May 20, 2015, 2 pages.

Field Sport, "Flip Up Front and Rear Back Up Iron Sight", downloaded from https://www.amazon.com/Flip-Front-Rear-Back-Sight/dp/B007D3P994/, retrieved on May 28, 2015, 9 pages.

* cited by examiner

Section B-B

Section C-C

Section E-E

LOW PROFILE FOLDING FRONT AND REAR FIREARM SIGHTS

CROSS-REFERENCE TO RELATED APPLICATIONS

This application claims the benefit of U.S. Provisional Patent Application No. 61/926,929, filed on Jan. 13, 2014, which is herein incorporated by reference in its entirety.

FIELD OF THE DISCLOSURE

The disclosure relates to firearms and more particularly to firearm sights.

BACKGROUND

Firearm design involves a number of non-trivial challenges, including the design of firearm sight mechanisms. Firearm aiming devices include optical scopes, lasers, and traditional rear and front alignment sights (sometimes referred to as iron sights). Considerations related to the design of a firearm sight may include size, functionality, and method of assembly and installation on a firearm.

SUMMARY

One example embodiment of the present invention provides a firearm sight assembly including: a base configured to attach to a firearm rail; an arm pivotally coupled to the base using a spring-loaded pivot pin; a sight attached to the arm; a linking pin connecting the pivot pin and the arm; and a bushing non-permanently attached to the base, wherein the bushing includes at least one slot; wherein the spring-loaded pivot pin forces the linking pin into the at least one bushing slot when the arm is in one of a deployed and folded position. In some cases, the at least one bushing slot is one of a locking slot and a detent slot. In some cases, the bushing includes four slots, each separated by approximately ninety degrees, the four slots comprise the following order: a locking slot, a locking slot, a detent slot, a detent slot. In some such cases, the bushing can be depressed and rotated to set the desired slot selections for the deployed and folded positions. In some cases, the at least one slot is one of a substantially U-shaped slot and a substantially V-shaped slot. In some cases, the spring-loaded pivot pin can be depressed to remove the linking pin from the at least one bushing slot. In some cases, the sight position can be adjusted relative to the arm. In some cases, the sight includes at least two blades, each blade including an aperture and each blade extending no farther than the arm. In some cases, the assembly includes a sight screw wheel attached to the sight, wherein the sight position can be adjusted by rotating the sight screw wheel. In some such cases, the sight screw wheel is countersunk in a slot in the arm. In some cases, the assembly includes a ball detent located at least partially in the base, the ball detent configured to horizontally align the arm relative to the base. In some cases, the assembly includes a ball detent located at least partially in the arm, the ball detent configured to apply pressure to the sight. In some cases, a longitudinal axis of the linking pin intersects a rotational axis of the pivot pin. In some cases, the linking pin is integral with the pivot pin.

Another example embodiment of the present invention provides a sight assembly including: a base; an arm pivotally coupled to the base using a pivot pin, wherein the arm includes a sight; a linking pin connecting the pivot pin and the arm; and a bushing non-permanently coupled with the base, wherein the bushing includes at least one slot configured to receive the linking pin. In some cases, the at least one slot in the bushing is one of a locking slot configured to substantially prevent rotation of the linking pin relative to the bushing and a detent slot configured to apply some resistance against rotation of the linking pin relative to the bushing. In some such cases, the locking slot is a substantially U-shaped slot and the detent slot is a substantially V-shaped slot. In some cases, the assembly includes a spring configured to directly or indirectly force the linking pin into the at least one slot.

Another example embodiment provides a firearm sight assembly including: a base configured to attach to a firearm rail; an arm pivotally coupled to the base using a spring-loaded pivot pin; a sight attached to the arm using a sight screw, the sight configured to be adjusted by rotating at least one of the sight screw and a wheel rotationally coupled to the sight screw; a linking pin connecting the pivot pin and the arm; and a bushing non-permanently attached to the base, wherein the bushing includes at least two slots; wherein the spring-loaded pivot pin forces the linking pin into one of the at least two bushing slots. In some cases, the at least two slots include at least one of a substantially U-shaped slot configured to substantially prevent rotation of the linking pin relative to the busing and a substantially V-shaped slot configured to apply some resistance against rotation of the linking pin relative to the bushing.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1A:
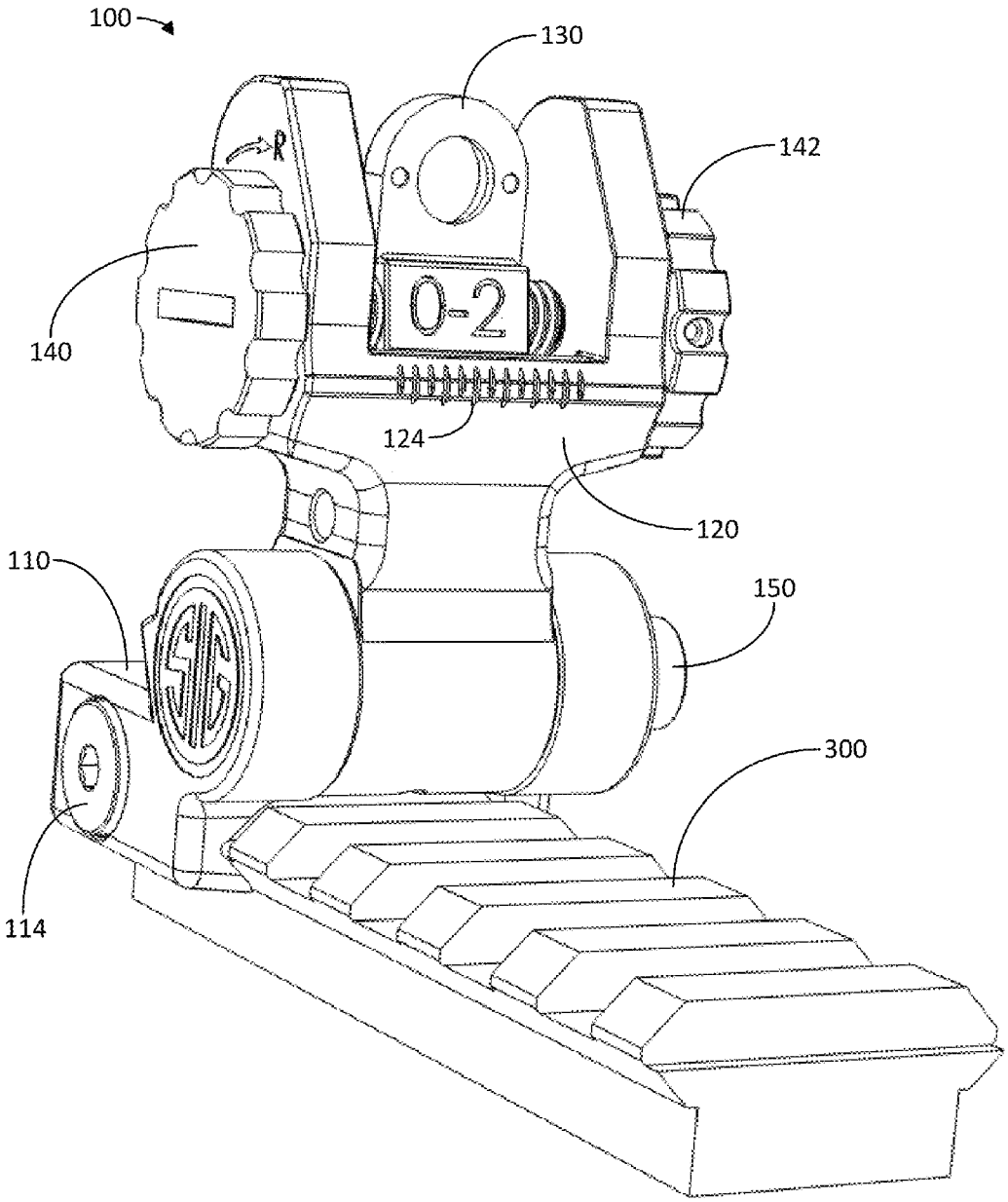
FIGS. 1*a* and 1*b* illustrate front isometric views of a rear sight assembly attached to a firearm rail, shown in deployed and folded positions, respectively, in accordance with an embodiment of the present disclosure.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the claimed invention to the specific configurations shown. In short, the figures are provided merely to show example structures.

DETAILED DESCRIPTION

Low profile folding front and rear firearm sights are disclosed. The firearm sights can be assemblies including a base, an arm, and a sight attached to the arm. The sight assemblies can also include a spring-loaded pivot pin configured to pivotally couple the arm to the base. The sight assemblies can also include a linking pin connecting the pivot and the arm. The linking pin may be inserted into the pivot pin, such that a longitudinal axis of the linking pin intersects a rotational axis of the pivot pin. The assemblies can also include a bushing that includes at least one slot and is non-permanently attached to the base. The spring-loaded pivot pin can force the linking pin into the at least one bushing slot when the arm is in a deployed and/or folded (or stowed) position. The slots may be either a locking slot, configured to lock the arm and prevent it from rotating until the pivot pin is depressed, or a detent slot, configured to provide resistance against rotation until a user manually rotates the arm from the detent slot position. Numerous configurations and variations will be apparent in light of this disclosure.

General Overview

As previously indicated, there are a number of non-trivial issues related to the design of firearm sight mechanisms. For example, such issues may relate to the size or robustness of a sight mechanism, the functionality of the mechanism (e.g., relating to folding/stowing the sight or adjusting the sight), the method of assembling the mechanism, and the method of installing the mechanism on a firearm. Whether a sight mechanism is intended to be a primary or back-up sight for a firearm may also be an important consideration for its design. It may be advantageous for back-up sight mechanisms to be compact, light, foldable/stowable, durable, adjustable (e.g., having the ability to change or adjust the sight/reticle or other features of the sight mechanism), easily assembled, and easily installed on a firearm.

Thus, and in accordance with a set of embodiments of the present disclosure, low profile folding front and rear sights are disclosed. In some embodiments, the firearm sights may be assemblies including a base, an arm, and a sight attached to the arm. The sight assemblies may also include a spring-loaded pivot pin configured to pivotally couple the arm to the base. The pivot pin may be located in a hole that runs along the bottom portion of the arm. In some instances, the pivot pin may also include a hole configured to receive a linking pin that connects or rotationally links the pivot pin to the arm. The linking pin may be inserted into the pivot pin, such that a longitudinal axis of the linking pin intersects a rotational axis of the pivot pin. In some instances, the linking pin may be configured to fit inside of a keyhole attached to the hole that runs along the bottom portion of the arm. The sight assemblies may also include a bushing that is non-permanently attached to the base and will be described in more detail below.

In some embodiments, the bushing may include one or more slots that are configured to receive the linking pin (while it is at least partially located in the pivot pin and the arm). The spring-loaded pivot pin may force the linking pin into the one or more slots when the arm is in different positions. For example, in one embodiment, a slot in the bushing may correspond with a deployed position of the arm and/or a slot in the bushing may correspond with a folded (or stowed) position of the arm. In some instances, the slots may be locking slots (e.g., U-shaped slots configured to mechanically the linking pin, as will be apparent in light of this disclosure) that lock the arm in one or more positions, such as the deployed and/or folded positions. In some such instances, the arm may not be able to be rotated/folded to another position until the pivot pin is depressed, thereby removing the linking pin from the locking slot. In some instances, the slots may be detent slots (e.g., V-shaped slots configured to resist rotation). In some such instances, the arm may be able to be rotated/folded to another position using an adequate amount of force to overcome the resistance (e.g., frictional resistance) supplied by linking pin being forced into the detent slot. In other words, the arm can be rotated/folded without depressing the pivot pin.

As will be appreciated in light of this disclosure, some embodiments may realize benefits or advantages as compared to existing approaches. For instance, in some embodiments, the horizontal position of the sight (relative to the arm) may be adjustable (e.g., in rear sight assemblies as variously described herein). In some embodiments, the vertical position of the sight (relative to the arm) may be adjustable (e.g., in front assemblies as variously described herein). In some instances, the position of the sights may be adjustable using a screw wheel that is attached to the sight, such that rotating the wheel adjusts the position of the sight relative to the arm (e.g., the horizontal and/or vertical position). In such instances, the sight assembly provides the benefit of adjusting the sight without need for any additional tools. In an example embodiment, the bushing may include four slots (which may be approximately ninety degrees apart), that are ordered: locking slot, locking slot, detent slot, detent slot (e.g., U, U, V, V shaped slots). In such an embodiment, the bushing may provide the following four slot combinations for deployed and stowed positions of the arm (deployed/stowed): locking/locking, locking/detent, detent/detent, detent locking. Further, a user may be able to easily switch the bushing (as will be discussed in more detail herein) to select the desired slot combination using, for example, a special tool.

In some embodiments, the rotational/locking/detent mechanism (e.g., using the spring-loaded pivot pin, linking pin, and bushing as described herein) can be located primarily within the arm to prevent moisture, dust, and dirt from penetrating into the mechanism. The design also provides, in some embodiments, increased corrosion resistance, making the sight assemblies as variously described herein suitable for aggressive environments. Further, when the arm is locked (e.g., in a deployed position using a locking slot), the arm is prevented from shaking, swinging, or folding, until a user chooses to fold the arm down. The arm can be easily folded from a locked position, by depressing the pivot pin and rotating the arm at the same time, which, in most instances, can be performed using one hand. In some cases, the pivot pin creates an easily found and easily utilized button, even in less than ideal conditions (e.g., when wearing gloves, when in low-light conditions, etc.). When the arm is aligned such that the linking pin is in a detent slot (e.g., when the arm is in a folded or stowed position), the sight assembly can be configured such that the arm will not move without manual assistance, at which point a user can easily rotate/fold the arm to another position.

Some embodiments may utilize small form factor components constructed from materials which are lightweight, resilient, inexpensive, etc. In some such embodiments, minimal mass, bulk, and/or height may be added to the host firearm, thereby helping to maintain a reliable, lightweight, and compact firearm. For example, as the height dimension of the sight assembly arm approaches a minimum practical length, a minimal height and length for the sight assembly can be achieved. Further, by the efficient use and compact arrangement of the rotation/locking/detent mechanism (as variously described herein), the sight assembly can allow for a smaller and lower profile sight assembly than conventional sight assemblies, which provides greater flexibility in use. This compact form can help to avoid interference with primary sights in instances where the sight assembly is used as a back-up sight, and facilitates attaching the sight assembly to short rails (e.g., short gas-block-mounted rails). Further, both rear and front sight assemblies are disclosed herein, allowing a user to use a rear assembly in combination with a front assembly to create a firearm sight system. In some embodiments, the arm may be designed with one or more slots that receive a sight screw, such that one or more of the sight screw ends fit inside of the slots, thereby preventing undesired movement of the sight caused by undesired rotation of the sight screw. Further, in some embodiments, the arm may be designed to protect the sight from damage in case of, for example, the firearm being dropped or the sight assembly being hit.

Some embodiments may have a small number of parts or components, and the components may be simple parts that are easy to manufacture or construct. Further, installation of the sight assembly components on a firearm frame may be simple and intuitive. Also, in some instances, a reduction in cost (e.g., of production, of repair, of replacement, etc.) may be realized. In some cases, and in accordance with some embodiments, a sight assembly as variously described herein can be configured, for example, as: (1) a partially/completely assembled sight assembly unit; and/or (2) a kit or other collection of discrete components (e.g., a base, an arm, a sight, etc.) which may be configured to assemble as desired. Numerous configurations and variations will be apparent in light of this disclosure.

Structure and Operation

Figure 1B:
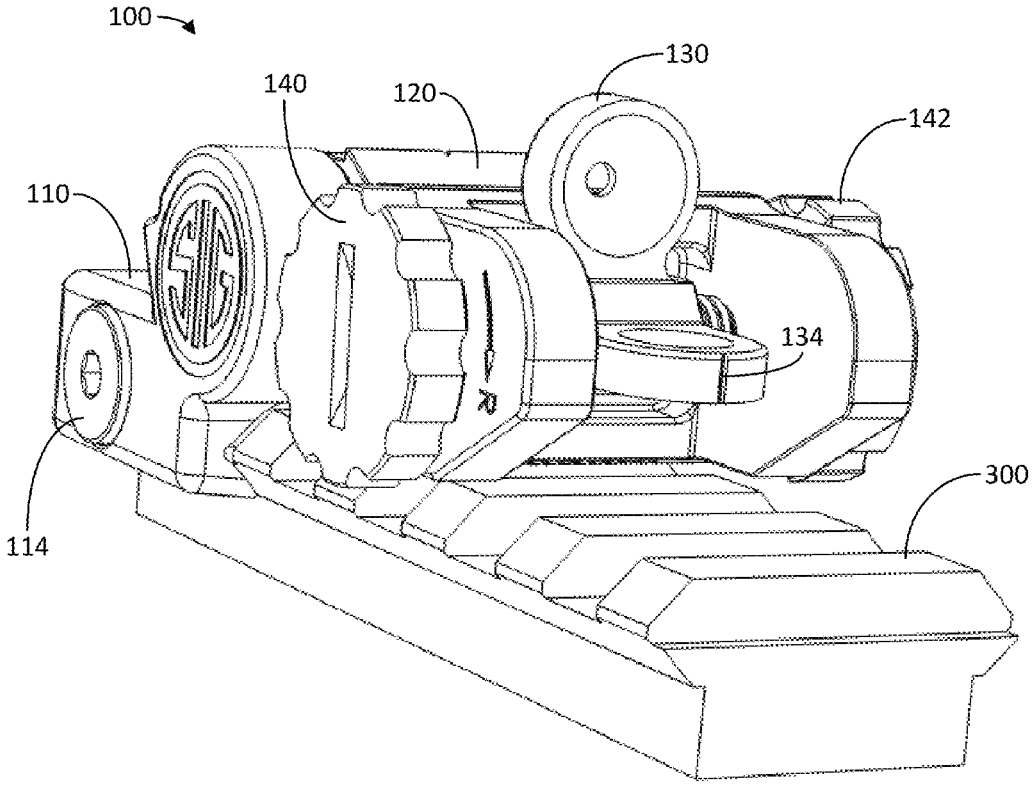
Figure 2:
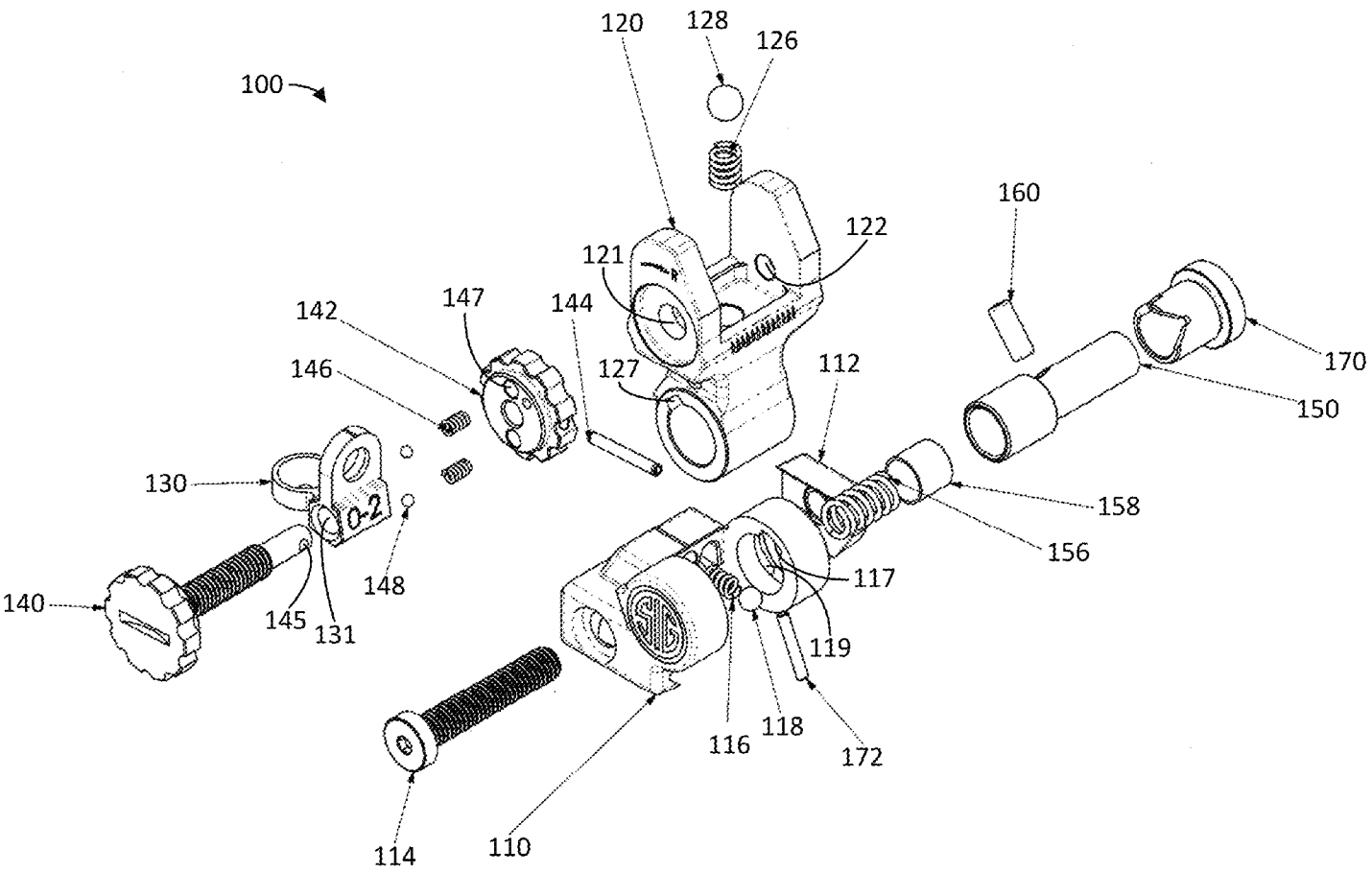
FIG. 2 illustrates an exploded view of the rear sight assembly of FIG. 1*a*.

FIGS. 1*a* and 1*b* illustrate front isometric views of rear sight assembly 100 attached to firearm rail 300, shown in deployed and folded positions, respectively, in accordance with an embodiment of the present disclosure. FIG. 2 illustrates an exploded view of rear sight assembly 100 shown in FIG. 1*a*. Generally, rear sight assembly 100 in this embodiment includes base 110, arm 120, sight 130, sight screw 140, pivot pin 150, linking pin 160, and bushing 170. In this embodiment, base 110 of sight assembly 100 is configured to attach to firearm rail 300 using clamp 112 and clamp bolt 114. Therefore, sight assembly 100 may be attached by inserting clamp bolt 114 through base 110 and screwing clamp bolt 114 into clamp 112 when sight assembly 100 is in a desired location on rail 300. In some instances, clamp bolt 114 may be loosened, to allow sight assembly 100 to be slid onto rail 300 from the front or rear of the rail, or from above the rail, and then tightened on a desired location on rail 300. In other embodiments, sight assembly 100 may be configured to attach to a firearm in another suitable manner. For example, clamp 112 may be integral with base 110, such that they are one piece and base 110 can be slid onto rail 300 and then tightened at a desired location (e.g., using a set screw).

The firearm rail 300 shown in this embodiment is a Picatinny rail (also known as a MIL-STD-1913 rail, STANAG 2324 rail, tactical rail, or M1913) that may be used on a firearm to provide a standardized mounting platform for accessories and attachments, such as for attaching sight assembly 100 as shown in FIGS. 1*a-b*. In other embodiments, sight assembly 100 may be configured to attach to different firearm rails, such as a Weaver rail mount, NATO accessory rail (NAR), or any other suitable firearm rail or rail interface system (RIS) as will be apparent in light of this disclosure. As will also be apparent in light of this disclosure, sight assembly 100 as variously described herein may be used with any suitable firearm. For example, sight assembly 100 may be used with various pistols (e.g., the P220® pistol), various rifles, (e.g., the SIG516®, SIG716® and SIGM400® rifles), and various machine/submachine guns (e.g., the SIG MPX™ submachine gun), just to name a few firearm examples (note that the specific firearm examples provided are all produced by Sig Sauer, Inc.). Sight assembly 100 as described herein may also be used on replica firearms, such as airsoft guns, for example. Note that the sight assembly as variously disclosed herein is not intended to be limited for use with any particular firearm rail or RIS, or any particular firearm, unless otherwise indicated.

Figure 3B:
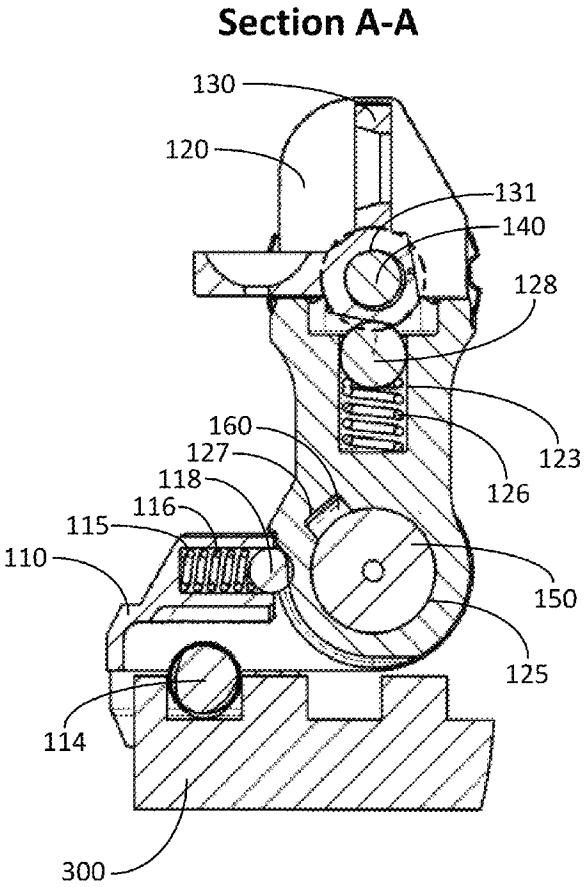
FIG. 3*b* illustrates a cross-sectional view along line A-A of the configuration shown in FIG. 3*a*.
Figure 3A:
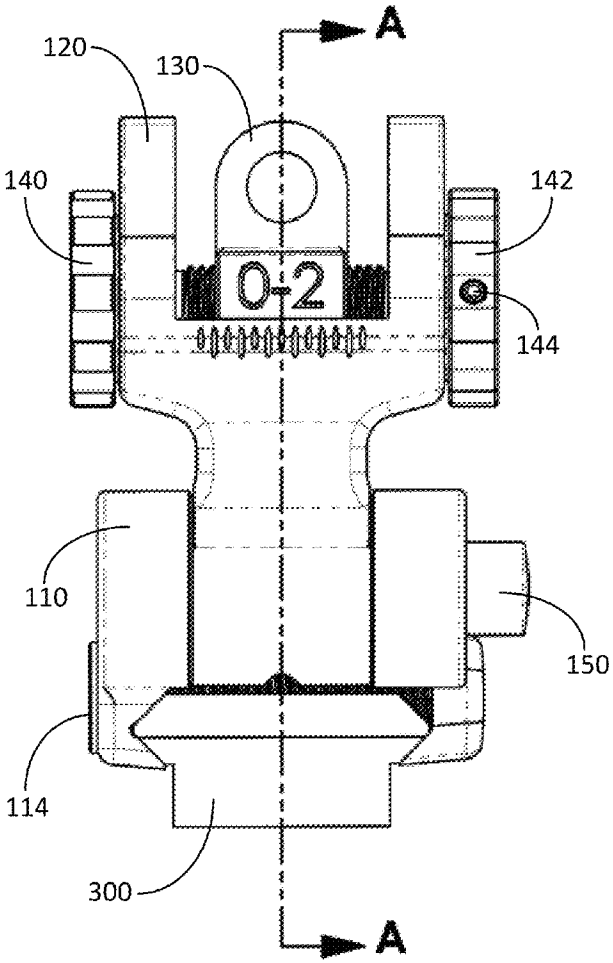
FIG. 3*a* illustrates a front planar view of the rear sight assembly of FIG. 1*a*.
Figure 4A:
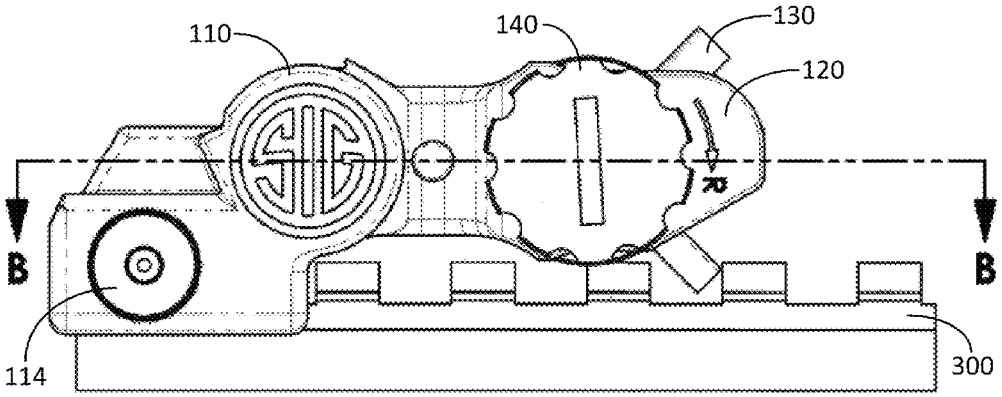
FIG. 4*a* illustrates a right planar view of the rear sight assembly of FIG. 1*b*.
Figure 4B:
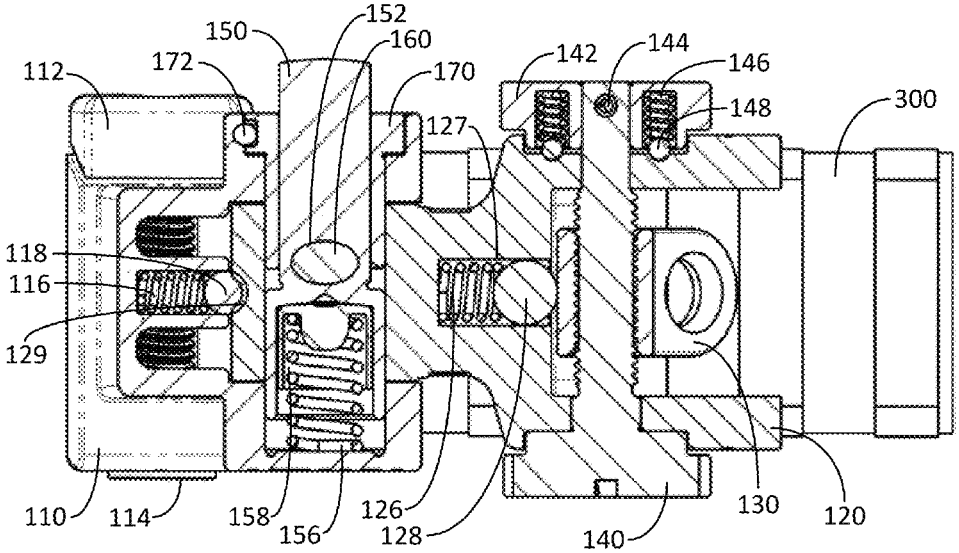
FIG. 4*b* illustrates a cross-sectional view along line B-B of the configuration shown in FIG. 4*a*.

The exploded view of FIG. 2 helps illustrate an example method of assembling rear sight assembly 100. FIG. 3*a* illustrates a front planar view of rear sight assembly 100 attached to firearm rail 300 and shown in a deployed position, in accordance with an embodiment of the present disclosure. FIG. 3*b* illustrates a cross-sectional view along line A-A of rear sight assembly 100 attached to firearm rail 300 as shown in FIG. 3*a*. FIG. 4*a* illustrates a right planar view of rear sight assembly 100 attached to firearm rail 300 and shown in a folded position, in accordance with an embodiment of the present disclosure. FIG. 4*b* illustrates a cross-sectional view along line B-B of rear sight assembly 100 attached to firearm rail 300 as shown in FIG. 4*a*. The cross-sectional views of FIGS. 3*b* and 4*b* help illustrate particular aspects of rear sight assembly 100 and will be discussed in more detail herein.

Continuing with the exploded view of the embodiment shown in FIG. 2, and as previously described, clamp bolt 114 is configured to insert through base 110 and then screw into clamp 112 (to allow sight assembly to be attached to firearm rail 300). Arm 120 can be pivotally coupled to base 110 by inserting pivot pin 150 into hole 125 of arm 120 (e.g., as can be seen in FIG. 3*b*). Prior to inserting pivot pin 150 into hole 125 to pivotally couple arm 120 to base 110, linking pin 160 can be inserted into linking pin hole 152 of pivot pin 150. Note that in this embodiment, a longitudinal axis of linking pin 160 intersects a rotational axis of pivot pin 150. In other words, in this embodiment, linking pin 160 and pivot pin 150 are substantially perpendicular. In this embodiment, pivot pin 150 can be inserted into hole 125 of arm 120 when arm 120 is in a folded position relative to base 110, such that linking pin 160 can be inserted through keyhole 117 in base 110 and keyhole 127 in sight arm 120 (keyholes 117, 127 indicated in FIG. 2). When pivot pin 150 including linking pin 160 is inserted into arm 120, arm 120 and pivot pin 150 become linked, such that when one of the arm 120 and pivot pin 150 rotates/pivots, the other one correspondingly pivots/rotates. FIG. 3*b* shows pivot pin 150 and linking pin 160 located inside of arm 120 in this embodiment, and more specifically, pivot pin 150 is at least partially located inside of hole 125 in arm 120 and linking pin 160 is at least partially located in keyhole 127 coupled to hole 125 in arm 120. Note that in some embodiments, linking pin 160 may be integral with pivot pin 150, such that they are one continuous part.

FIGS. 2 and 4*b* show that pivot pin 150 can be spring-loaded by inserting spring 156 and spring cap 158 between base 110 and pivot pin 150 prior to inserting pivot pin 150 into hole 125 (e.g., as can be seen in FIG. 4*b*). Depressing pivot pin 150 when it is spring-loaded compresses spring 156, and thereby moves pivot pin 150, spring cap 158, and linking pin 160 farther into arm 120 (e.g., in a downward direction relative to the view shown in FIG. 4*b*). As can be seen in FIG. 4*b*, bushing 170 can be inserted into and attached to base 110 to secure spring 156, spring cap 158, and pivot pin 150 (including linking pin 160) inside of arm 120. Bushing 170 can be attached to base 110, in this embodiment, by aligning flat surface 173 of bushing 170 (shown in FIG. 7*a*) with hole 119 in base 110 (shown in FIG. 2), and then inserting locking pin 172 into hole 119. Note that in this example embodiment, bushing 170 cannot rotate relative to base 110 once locked into base 110 using locking pin 172 (which may be, for example, a dowel pin). Also note that prior to pivotally coupling arm 120 to base 110, spring 116 and ball 118 can be inserted into bore 117 in base 110 to provide a ball detent to help align arm 120 relative to base 110. In this example embodiment, the ball detent (provided by spring 116 and ball 118) applies pressure against slot 129 of arm 120 to help maintain horizontal alignment of arm 120 relative to base 110 (e.g., as can be seen in FIG. 4*b*).

FIGS. 2 and 3*a* show that sight 130 can be pivotally coupled to arm 120 by inserting sight screw 140 through hole 121 near the top of arm 120, through sight hole 131, and then through hole 122 and out the other side of arm 120 (holes 121, 122 indicated in FIG. 2). Sight screw wheel cap 142 can then be secured to sight screw 140 using pin 144 (which may be, for example, a slotted spring pin). Prior to attaching sight screw wheel cap 142 to sight screw 140 using pin 144, in this embodiment, springs 146 and corresponding balls 148 can be inserted into holes 147 (indicated in FIG. 2) in wheel cap 142 to spring-load cap 142 (e.g., as can be seen in FIG. 4*b*). In this example embodiment, sight screw 140 and/or wheel cap 142 can be rotated to adjust the horizontal position of sight 130. In some instances, arm 120 may include indentations in the area that springs 146 and balls 148 rotate over, such that tactile and/or aural feedback (e.g., one or more clicks) is provided when rotating sight screw 140 or wheel cap 142 to adjust the horizontal location of sight 130. For example, one click of sight screw 140 (and/or wheel cap 142) may be equal to ½ MOA or some other suitable adjustment. In some instances, sight 130 and sight screw 140 may have a roller screw configuration, such that rotating sight screw 140 (and/or wheel cap 142) causes sight 130 to move in a substantially linear motion.

In this embodiment, sight 130 is a dual aperture sight, and therefore sight 130 can be manually flipped as desired when arm 120 is deployed to select one of the large aperture shown in FIG. 1*a* and the small aperture shown in FIG. 1*b*. In other embodiments, sight 130 may include other sights/reticles/apertures, such as a ring, a bead, a crosshair, a notch (e.g., a U or V-notch), or an open aperture for use in an open sight configuration, such as a U-notch and post, a V-notch and bead, or a ghost rings configuration, for example. Any suitable configuration may be used for sight assembly 100, and the example dual aperture sight 130 is provided for illustrative purposes and is not intended to limit the present disclosure, unless otherwise indicated. Note that prior to pivotally coupling sight 130 to arm 120 using sight screw 140, spring 126 and ball 128 can be inserted into bore 123 in arm 120 to provide a ball detent to help maintain the desired aperture of sight 130 when flipping between the large and small apertures. In this example embodiment, the ball detent (provided by spring 126 and ball 128) applies pressure against sight 130 to help maintain the selected aperture after flipping to that desired aperture. The ball detent (provided by spring 126 and ball 128) may also be helpful in maintaining the selected aperture when adjusting the horizontal position of sight 130 using sight screw 140 (and/or wheel cap 142). Also note that arm 120 and sight 130 may include markings, indicators, etc. to help with the alignment of sight 130 relative to arm 120. For example, FIG. 1*a* shows markings 124 on arm 120 that may be used in combination to with indicator 134 on sight 130 to help with the alignment of sight 130 relative to arm 120.

The particular order of assembly for rear sight assembly 100 as described herein is provided for illustrative purposes only and is not intended to limit the method of assembly of sight assembly 100. Further the shapes and sizes of the components of sight assembly 100 may vary between embodiments. For example, the size and shape of base 110, clamp 112, and clamp bolt 114 may be selected based on the particular firearm rail sight assembly 100 is intended to be attached to. The components of sight assembly 100 (e.g., base 110, arm 120, sight 130, sight screw 140, pivot pin 150, linking pin 160, and bushing 170, and any other components as will be apparent in light of this disclosure) can be constructed from any suitable material, such as various metals (e.g., aluminum, steel, or any other suitable metal or metal alloy material) or plastics (e.g., polymers, such as polystyrene, polycarbonate, and polypropylene, or any other suitable polymer or plastic material). In an example embodiment, base 110 and arm 120 may be constructed from MIM 4140 low alloy steel.

In some cases, the dimensions of the sight assembly components may be selected based on the overall desired height, length, and/or width of the sight assembly, while in other cases, the overall height, length, and/or width of the sight assembly may be selected based on the desired dimensions of the sight assembly components. For example, the height of sight arm 120 may be selected to minimize the maximum overall height of sight assembly 100 (e.g., when in the deployed position), since sight arm 120 accounts for a substantial portion of the height of sight assembly 100. Specifically, sight arm 120 may be configured to have a height of 1, 2, 3, 4, 5, 7.5, or 10 cm, or some other suitable height to allow for a small form factor for sight assembly 100, 200 (e.g., less than 3, 4, 5, 6, 7, 9.5, or 12 cm where base 110 adds 2 cm to the overall height). In some instances, the maximum overall height of sight assembly 100 (in the deployed position) may be selected relative to the overall height of sight arm 120. For example, the overall height of sight assembly 100 may be selected to be less than 100%, 110%, 120%, or 150% of the overall height of sight arm 120. In some instances, the dimensions of sight assembly 100 and/or one or more of its components may be selected based on the firearm rail or firearm it is intended to be used with.

Figure 5A:
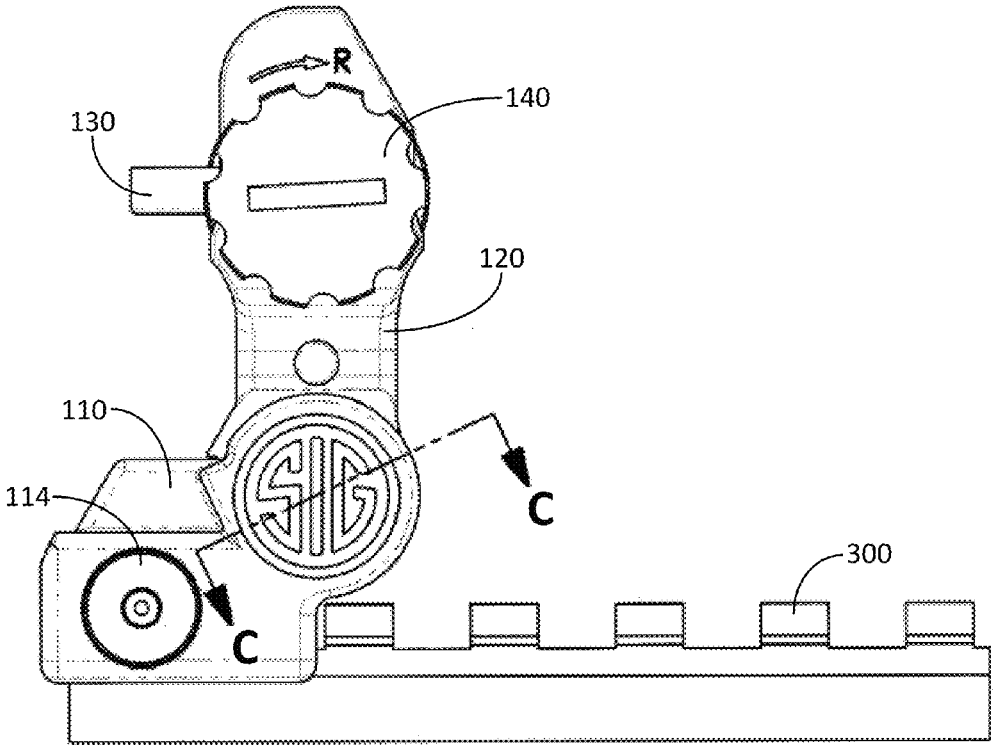
FIG. 5*a* illustrates a right planar view of the rear sight assembly of FIG. 1*a*.
Figure 5B:
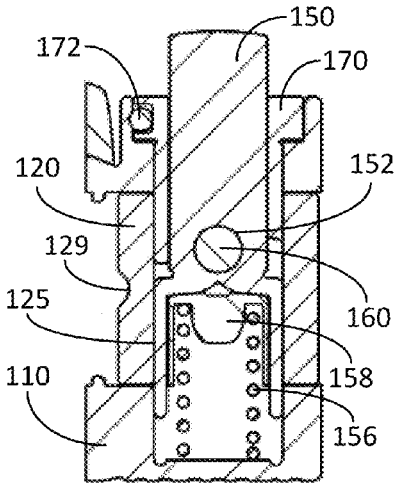
FIG. 5*b* illustrates a cross-sectional view along line C-C of the configuration shown in FIG. 5*a*.
Figure 6:
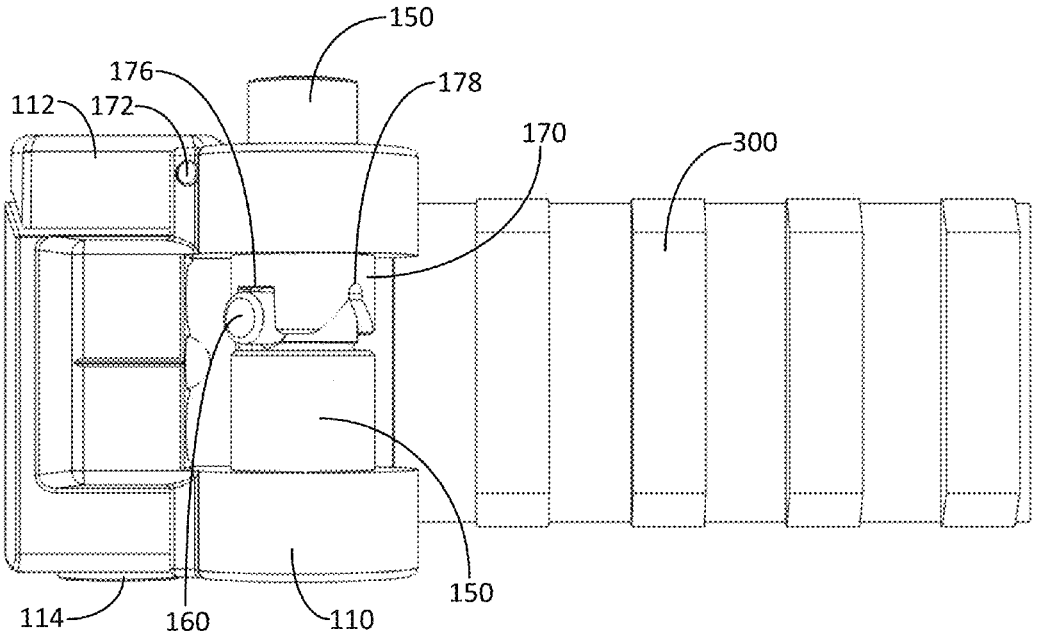
FIG. 6 illustrates a top planar view of a rear sight assembly attached to a firearm rail and shown in a deployed position (excluding the arm), in accordance with an embodiment of the present disclosure.
Figure 7A:
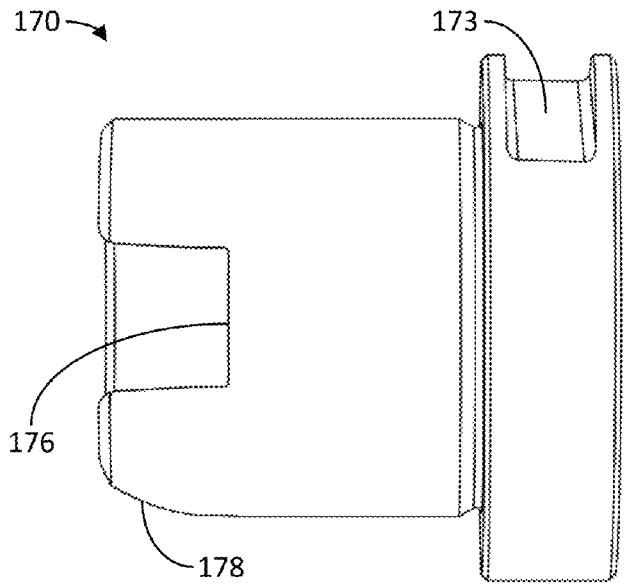
FIGS. 7*a-b* illustrate a top planar view and front planar view (based on a plane created by cross-sectional line C-C from FIG. 5*a*) of a bushing to be used with the sight assembly of FIG. 5*a*.
Figure 7B:
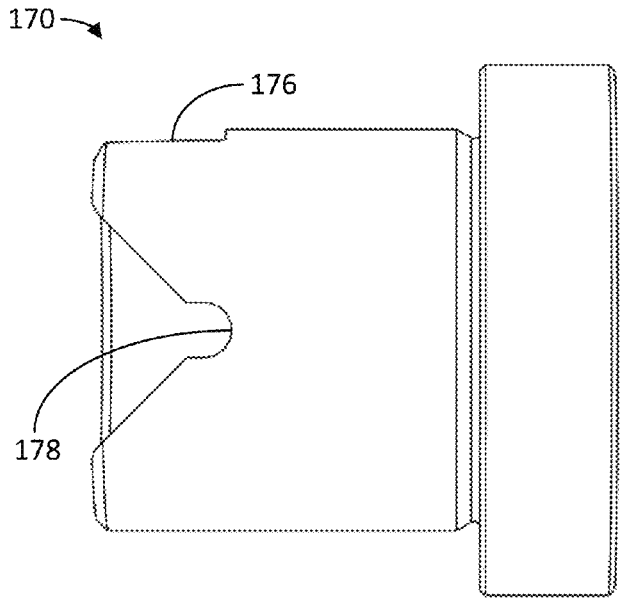

FIG. 5*a* illustrates a right planar view of rear sight assembly 100 attached to firearm rail 300 shown in a deployed position, in accordance with an embodiment of the present disclosure. FIG. 5*b* illustrates a cross-sectional view along line C-C of rear sight assembly 100 as shown in FIG. 5*a*. FIG. 6 illustrates a top planar view of rear sight assembly 100 attached to firearm rail 300 and shown in a deployed position (excluding arm 120), in accordance with an embodiment of the present disclosure. FIGS. 7*a-b* illustrate a top planar view and front planar view (based on a plane created by cross-sectional line C-C from FIG. 5*a*) of bushing 170 to be used with the sight assembly of FIG. 5*a*.

As can be seen in FIG. 5*b*, spring 156, spring cap 158, and pivot pin 150 (including linking pin 160) are secured in arm 120 by bushing 170. In this embodiment, spring 156 is in compression when bushing 170 is attached (e.g., using locking pin 172 as previously described). Therefore, spring 156 applies force on spring cap 158 and pivot pin 150. As can be seen in this example embodiment, the force being applied to pivot pin 150 is being transferred to the point of contact between linking pin 160 and bushing 170. In this example case, bushing 170 includes two slots, locking slot 176 (which is generally U-shaped as can be seen in FIGS. 6 and 7*a*) and detent slot 178 (which is generally V-shaped as can be seen in FIGS. 6 and 7*b*). In the deployed position shown in FIG. 10, linking pin 160 is being forced into locking slot 176 (by the force applied by spring 156). As can be understood, in this embodiment, locking slot 176 provides a mechanical block to linking pin 160 and locks arm 120 (when attached) in the deployed position, thereby preventing it from folding in either direction. To unlock arm 120 and make it available to be folded down, pivot pin 150 (which essentially becomes a push button as a result of the force provided by compressed spring 156) can depressed and then arm 120 can be folded downward. Note that pivot pin 150 creates an easily found and easily utilized button, even in less than ideal conditions (e.g., when wearing gloves, in low-light conditions, etc.).

As can also be understood, the shape of the detent slot 178 allows for arm 120 to be folded to another position without having to depress pivot pin 150. In other words, some resistance is provided by detent slot 178 when linking pin 160 is located in the detent slot 178, but detent slot 178 does not create a mechanical block (as opposed to locking slot 176). The default position of arm 120 when linking pin 160 is in detent slot 178 can be seen in the fully folded/stowed position shown in FIG. 4*a*, for example. Locking slot 176 and detent slot 178 in this example embodiment are configured to interface with linking pin 160; however, any suitable combination of linking pin and detent/locking slots may be used in other embodiments. For example, in another embodiment, the linking pin may be rectangular in shape and an associated locking slot may be rectangular in shape while an associated detent slot may be semi-circular in shape. As previously described, bushing 170 in the embodiment shown in FIGS. 6 and 7*a-b* includes two slots 176, 178. Note that slots 176 and 178 have ninety degrees of separation between them, since arm 120 folds ninety degrees from a deployed position to a fully folded/stowed position. In some embodiments, the bushing may include only one slot (e.g., a detent or locking slot), such that the contact between the bottom of the bushing and linking pin 160 merely provides frictional resistance to folding when not in the position associated with the single slot.

In some embodiments, the bushing may have more than two slots at its bottom configured to interface with linking pin 160 (or some other suitable linking pin). For example, in one embodiment, the bushing may include four slots (each of which may be separated by ninety degrees of separation), ordering detent slot, detent slot, locking slot, locking slot, as you go around the bushing (e.g., U, U, V, V, using the shapes of the slots as previously discussed). Such a bushing may allow a user to set the desired slot combination for deployed and folded positions, yielding the following combinations (deployed/folded): locking/detent (e.g., as is the case with bushing 170), detent/detent, detent/locking, locking/locking. In some such embodiments including such a bushing having four slots (e.g., U, U, V, V), the sight assembly may include a method of easily changing the selected slot combination (e.g., as will be discussed in more detail below with reference to FIGS. 8*a-b*). The bushing may include any number of slots (whether locking and/or detent slots), as will be apparent in light of this disclosure, and the bushing is not intended to be limited to any particular number of slots unless otherwise indicated.

Figure 8A:
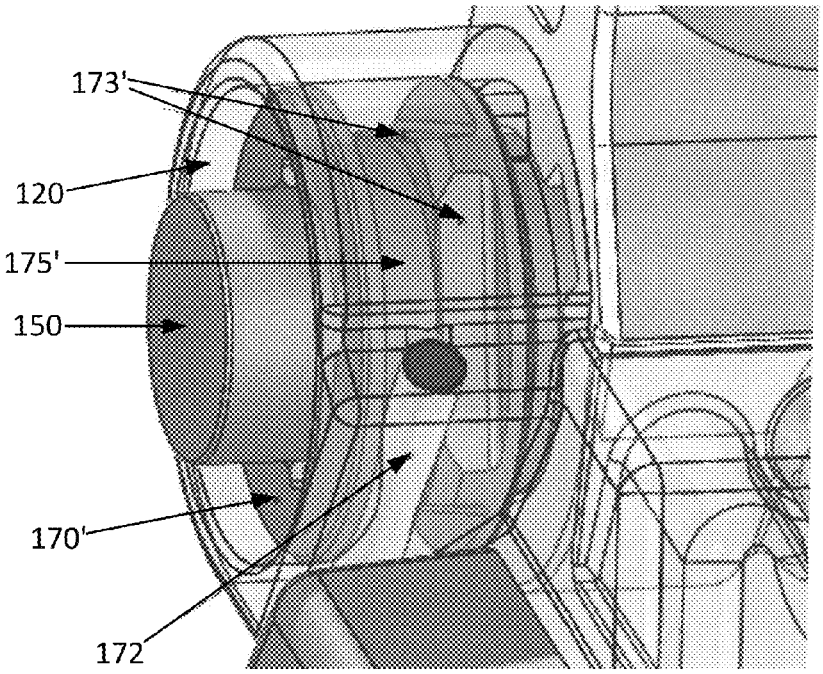
FIGS. 8*a-b* illustrate an example bushing for a sight assembly, configured in accordance with an embodiment of the present disclosure.
Figure 8B:
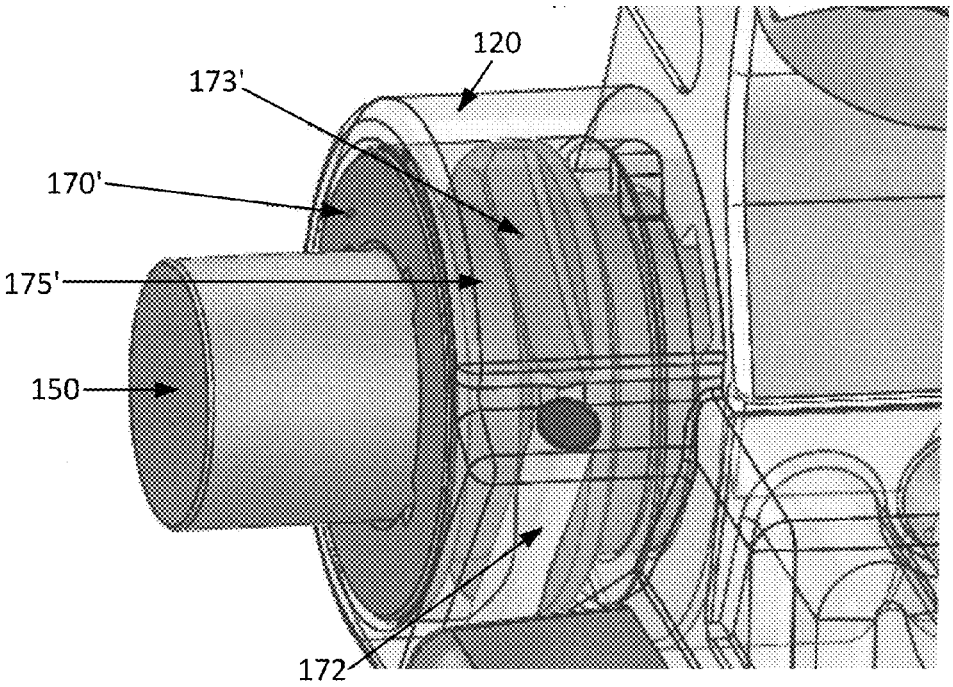

FIGS. 8*a-b* illustrate an example bushing 170' for sight assembly 100, configured in accordance with an embodiment of the present disclosure. Note that bushing 170' is shown being used with sight assembly 100 as previously described herein (i.e., where bushing 170 was replaced with bushing 170'). Bushing 170' includes four slots as described in the previous example bushing (e.g., U, U, V, V). Bushing 170' also includes four flat surfaces 173' (two of which can be seen in FIGS. 8*a-b*) and groove 175' that allows bushing 170' to be depressed and rotated to a desired slot combination. A special tool (e.g., a modified screwdriver or a special key) configured to allow a user to depress bushing 170' (thereby compressing spring 156) and rotate bushing 170' between the four working positions may be used (which can, for example, be supplied with sight assembly 100 if using bushing 170' or some other suitable bushing having more than two slots). FIG. 8*a* shows bushing 170' in transition between flat surfaces (and thus, in transition between two of the four slot combination selections). FIG. 8*b* shows bushing 170' in working position, where one of the flat surfaces is in contact with locking pin 172. In some embodiments, bushing 170' may be marked on its outside face to indicate what slot combinations are selected relative to the rotation of the bushing 170', such that the user can readily identify which slot combination is being selected. The method of switching between slot combinations for a bushing having more than two slots shown in FIGS. 8*a-b* is provided for illustrative purposes and is not intended to limit the present disclosure.

Figure 9A:
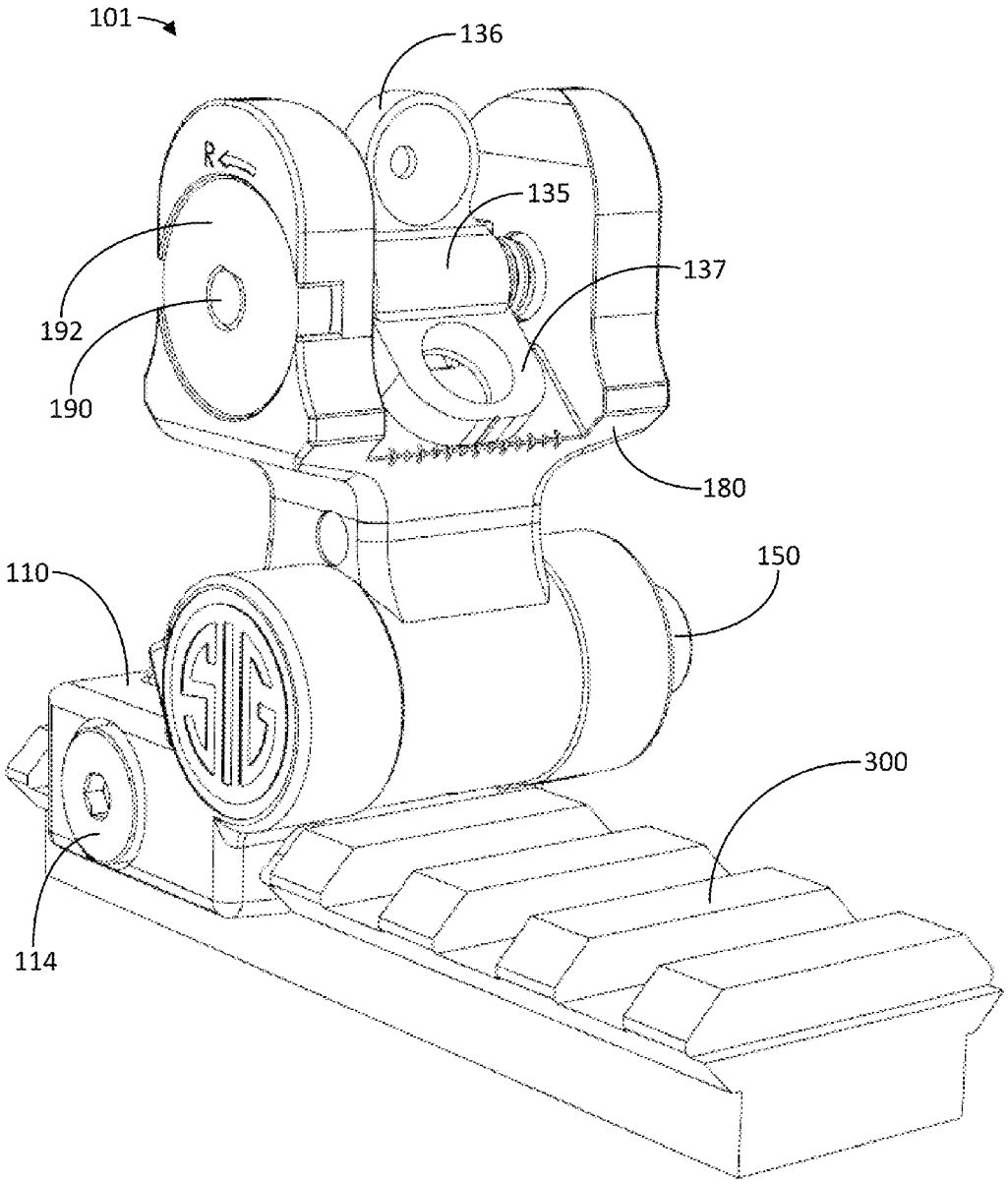
FIG. 9*a* illustrates a front isometric view of a rear sight assembly attached to a firearm rail and shown in a deployed position, in accordance with another embodiment of the present disclosure.
Figure 9B:
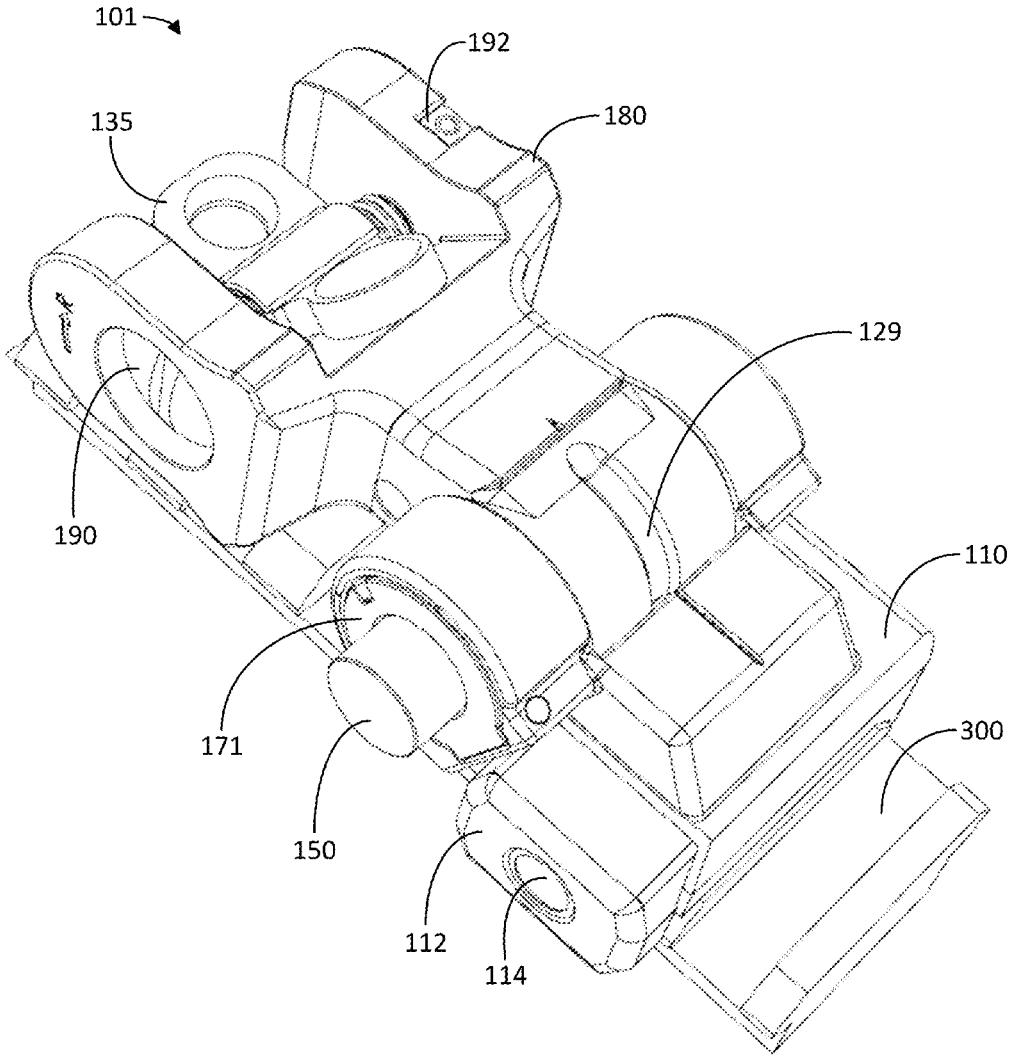
FIG. 9*b* illustrates a rear isometric view of the rear sight assembly of FIG. 9*a* shown in a folded position.
Figure 10:
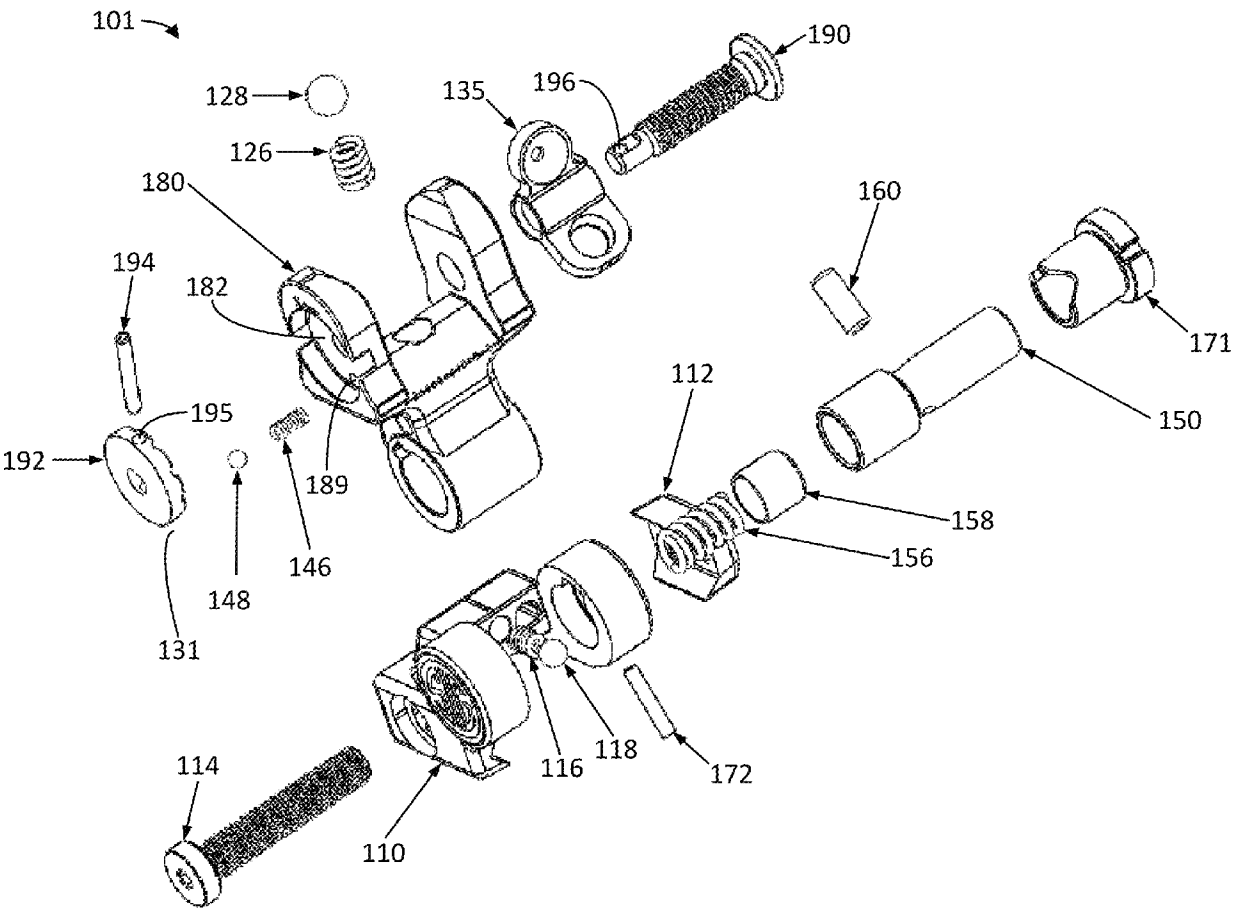
FIG. 10 illustrates an exploded view of the rear sight assembly of FIG. 9*a*.
Figure 11B:
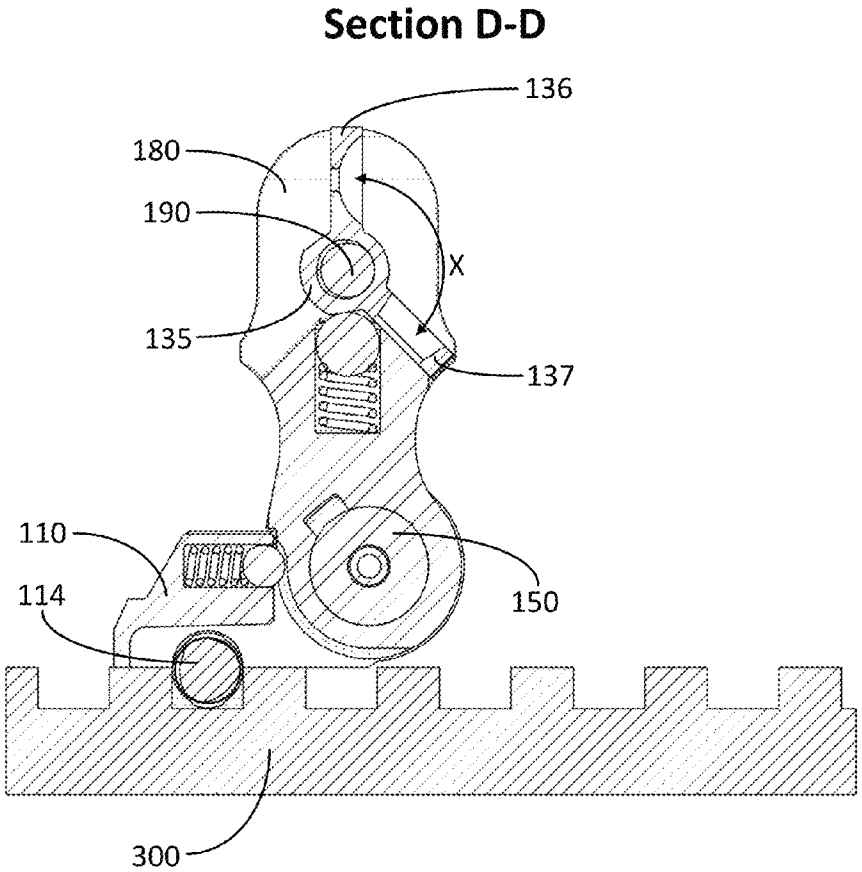
FIG. 11*b* illustrates a cross-sectional view along line D-D of the configuration shown in FIG. 11*a*.
Figure 11A:
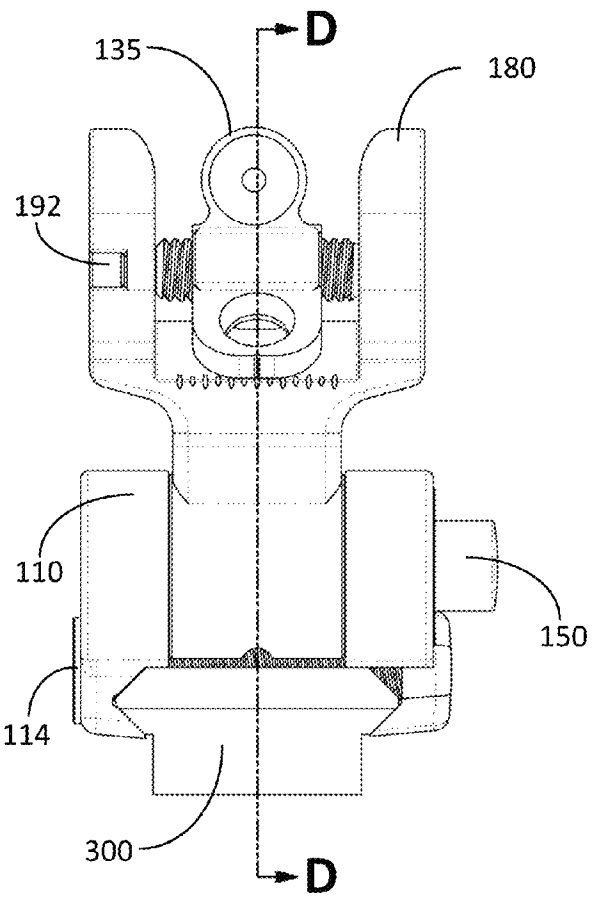
FIG. 11*a* illustrates a front planar view of the rear sight assembly of FIG. 9*a*.

FIG. 9*a* illustrates a front isometric view of rear sight assembly 101 attached to firearm rail 300 and shown in a deployed position, in accordance with another embodiment of the present disclosure. FIG. 9*b* illustrates a rear isometric view of rear sight assembly 101 shown in a folded position. FIG. 10 illustrates an exploded view of rear sight assembly 101 shown in FIG. 9*a*. FIG. 11*a* illustrates a front planar view of rear sight assembly 101. FIG. 11*b* illustrates a cross-sectional view along line D-D of the configuration shown in FIG.

Figure 12A:
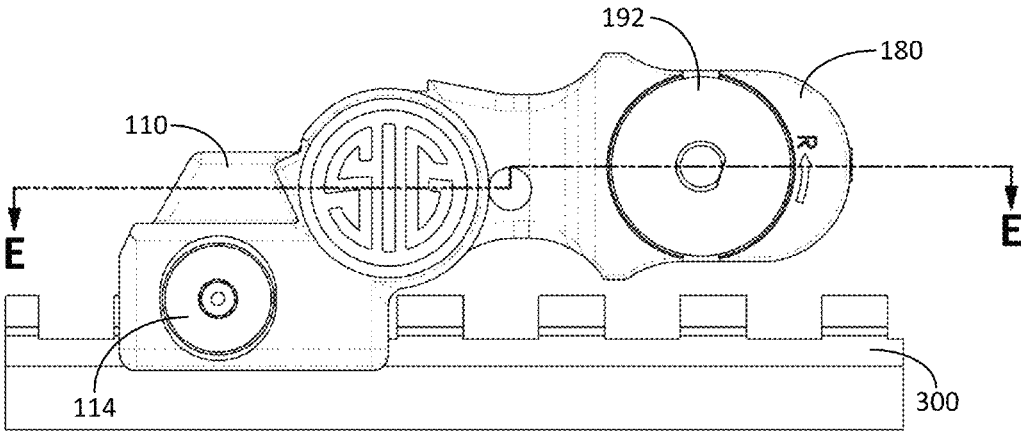
FIG. 12*a* illustrates a right planar view of the rear sight assembly of FIG. 9*b*.
Figure 12B:
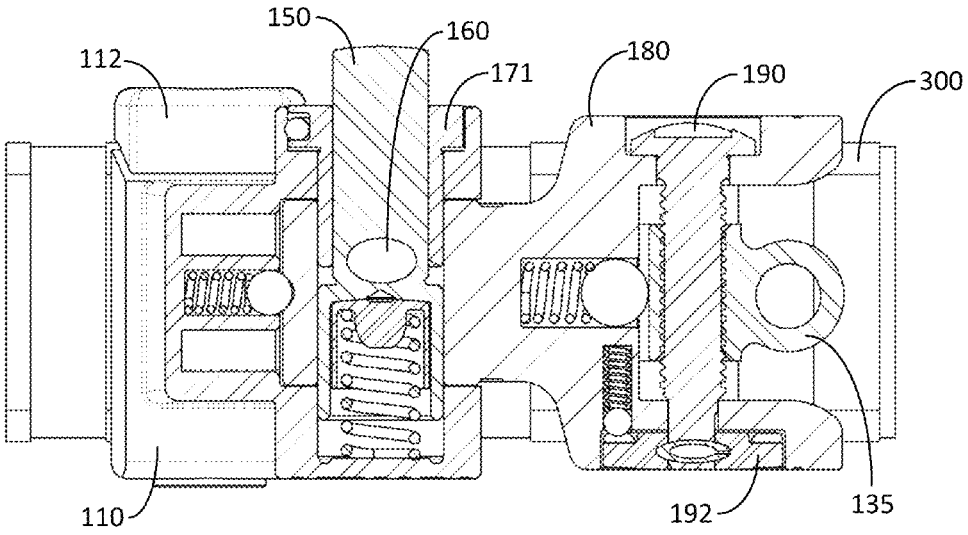
FIG. 12*b* illustrates a cross-sectional view along line E-E of the configuration shown in FIG. 12*a*.

11*a*. FIG. 12*a* illustrates a right planar view of rear sight assembly 101. FIG. 12*b* illustrates a cross-sectional view along line E-E of the configuration shown in FIG. 12*a*. Generally, rear sight assembly 101 includes similar components as rear sight assembly 100, and therefore the discussion of such similar components herein (e.g., base 110, pivot pin 150, linking pin 160, etc.) applies equally to rear sight assembly 101 as it does to rear sight assembly 100. However, rear sight assembly 101 includes some differences in the arm, sight, and sight screw as compared to rear sight assembly 100, as well as some additional different components, as will be described in more detail herein with respect to FIGS. 9*a-b*, 10, 11*a-b*, and 12*a-b*.

As can be seen in FIG. 10, sight screw 190 is installed in arm 180 of rear sight assembly 101 in a similar manner that sight screw 140 is installed in arm 120 of rear sight assembly 100. For example, sight screw 190 passes through the hole in the top of arm 180, through the hole in sight 135, and through the second aligned hole in the top of arm 180. Then screw cap wheel 192 is attached to sight screw 190 using pin 194, which passes through hole 195 of screw cap wheel 192, through hole 196 in sight screw 190, and then back through hole 195. However, as can be seen in FIG. 9*a*, screw cap wheel 192 is countersunk and sits inside of slot 182 in arm 180. Further, screw 190, when seated, is countersunk in a slot in the opposed side of arm 180, as can be seen in FIG. 9*b*. FIG. 12*b* also illustrates how screw 190 and screw cap wheel 192 sit inside of slots in arm 180. Thus, the length of screw 190 and screw cap wheel 192, as assembled in this example embodiment, is less than the width of arm 180; however, in some embodiments, the length of screw 190 and screw cap wheel 192 may be equal to the width of arm 180. In some such embodiments, where screw 190 and screw cap wheel 192 do not extend beyond the width of arm 180, screw 190 and screw cap wheel 192 may be protected from undesired adjustments and thereby prevent sight 135 from being accidentally moved.

In some embodiments, screw 190 and/or screw cap wheel 192 may be rotated using a tool, such as using a screwdriver to rotate screw 190. In some such embodiments, a tool may be required to rotate screw 190 and/or screw cap wheel 192, which may prevent undesired rotation and thereby prevent sight 135 from being accidentally moved. Note that slot 182 in arm 180 includes additional slot 189 configured to receive spring 146, as can be seen in FIG. 10. Also note that bushing 171 in example assembly 101 illustrates another example bushing design that can be used with the sights variously described herein. For example, comparing FIG. 2 to FIG. 10, it can be seen that the detent slot in bushing 171 has a different shape than the detent slot in bushing 170. Note that both of the detent slots in bushing 170 and 171 are substantially V-shaped slots. Numerous variations and configurations of the bushing will be apparent in light of this disclosure.

As can be seen in FIGS. 9*a* and 11*b*, sight 135 includes two blades 136 and 137. As previously described with respect to sight 130, sight 135 is a dual aperture sight. Blade 136 includes a smaller diameter aperture than does blade 137, as can be seen in FIG. 9*a*. Blades 136 and 137, in this example embodiment, are separated by angle X, which is approximately 125 degrees. However, blades 136 and 137 may be designed such that angle X is any suitable value, such as any angle between 75 and 145 degrees. As can be seen in FIG. 11*b*, arm 180 and sight 135 are designed in this example embodiment such that sight 135 (including blades 136 and 137) are fully covered by arm 180. In other words, blades 136 and 137 of sight 135 extend no higher than the distal end of arm 180, such that if rear sight assembly 101 were hit or if the firearm that assembly 101 is installed on were to be dropped, arm 180 would provide at least some protection for sight 135 (as compared to a design where, for example, at least one sight blade extends beyond arm 180).

Figure 13A:
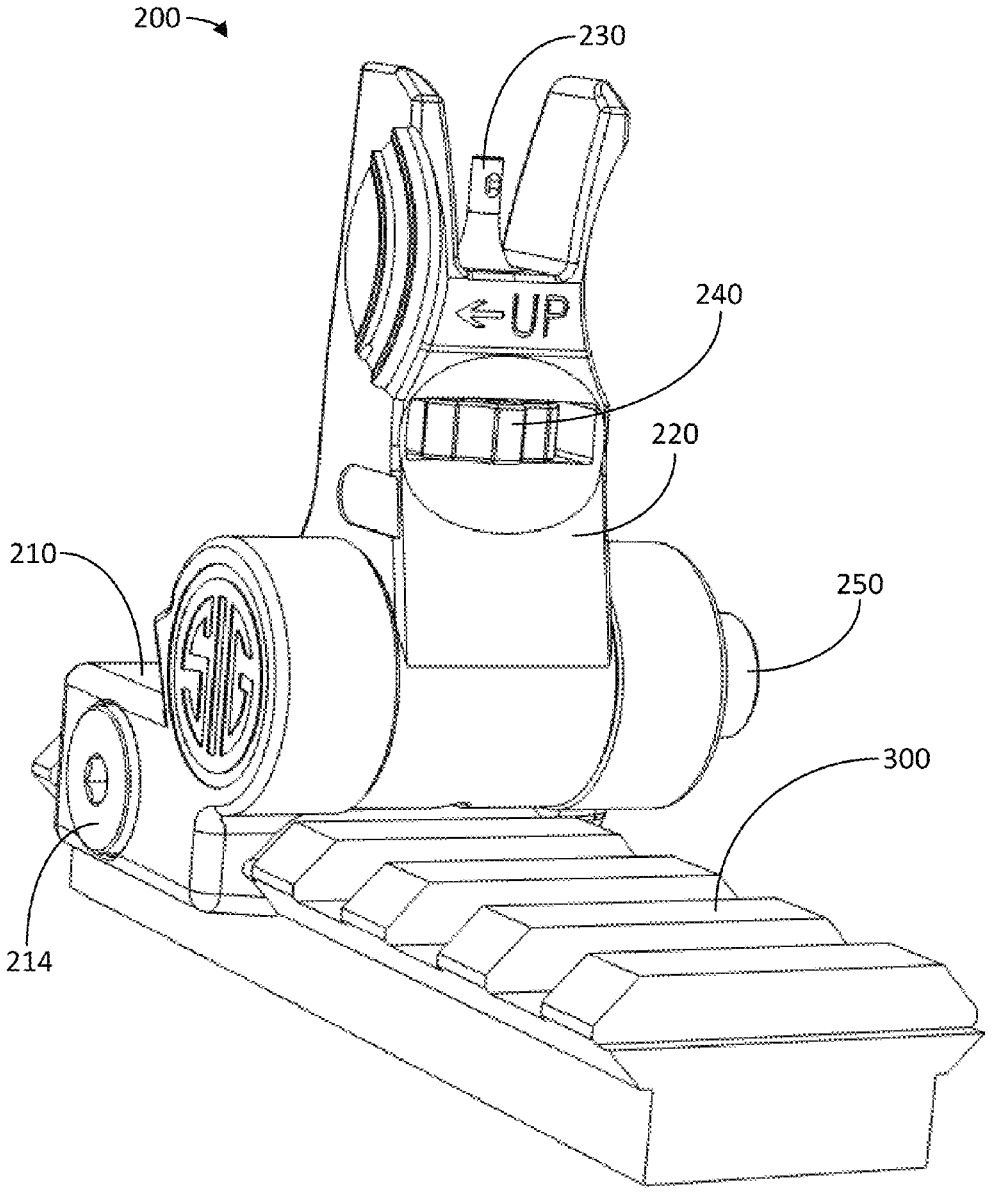
FIGS. 13*a-b* illustrate front isometric views of a front sight assembly attached to a firearm rail, shown in deployed and folded positions, respectively, in accordance with an embodiment of the present disclosure.
Figure 13B:
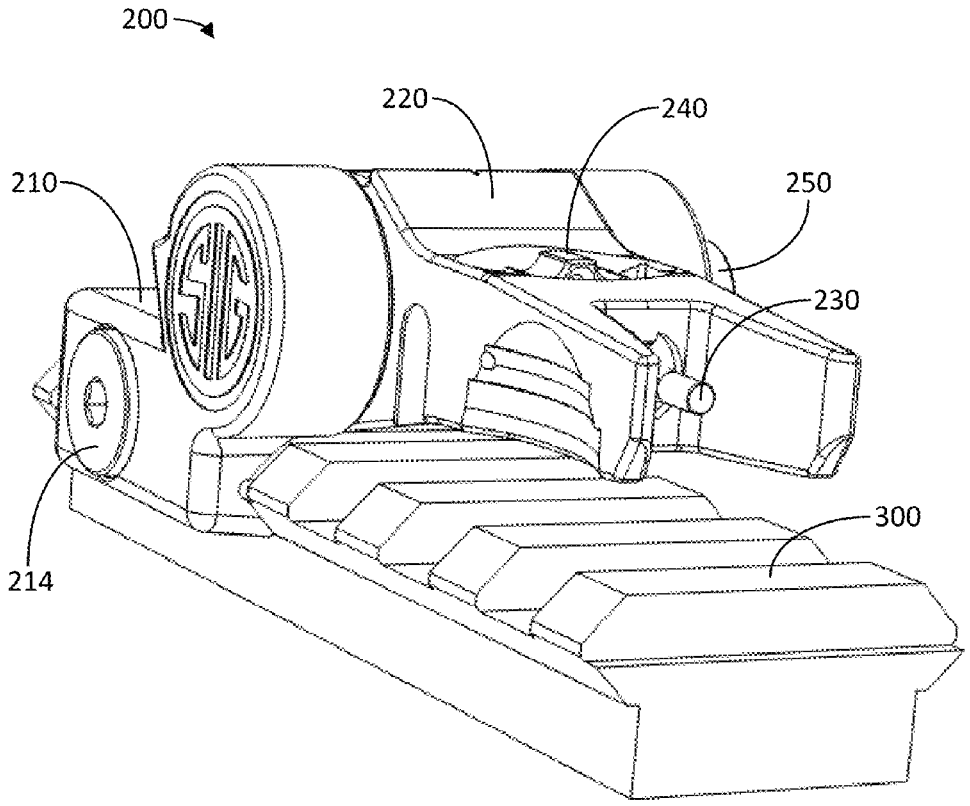
Figure 14:
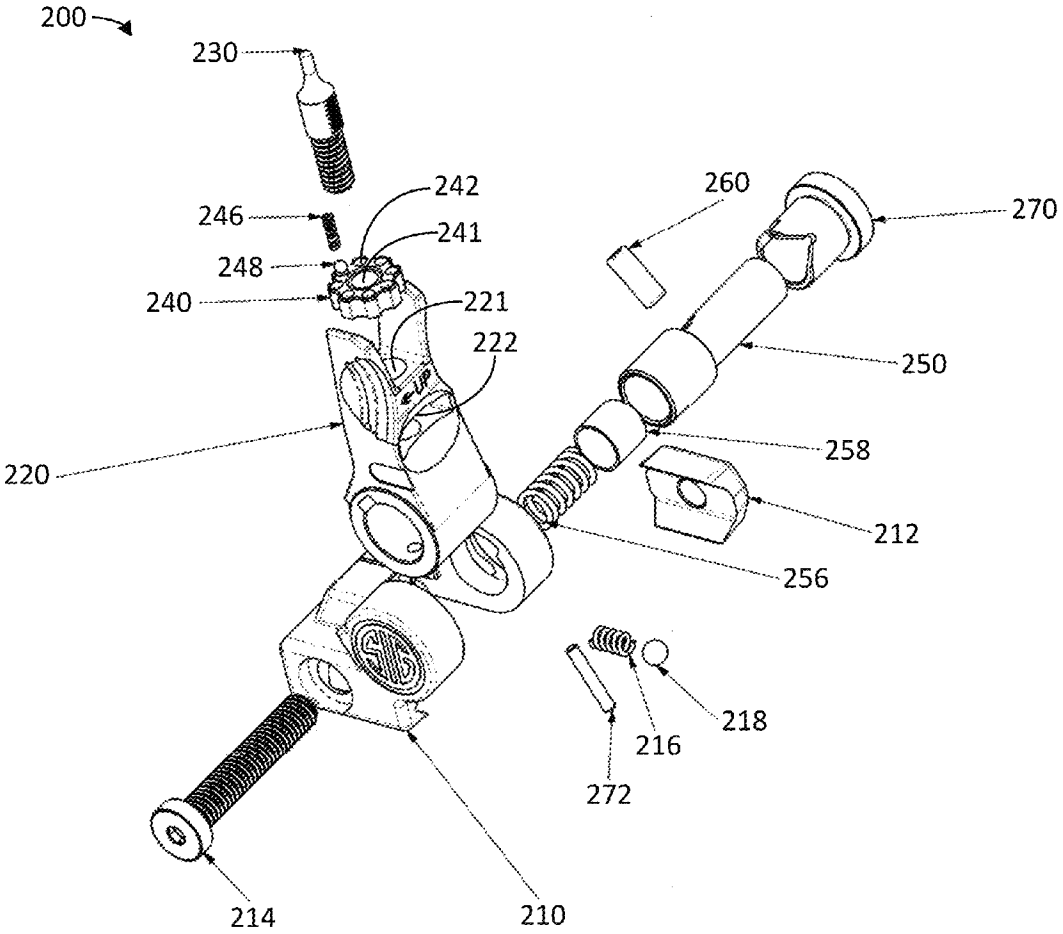
FIG. 14 illustrates an exploded view of the front sight assembly as shown in FIG. 13*a*.

FIGS. 13*a-b* illustrate front isometric views of front sight assembly 200 attached to firearm rail 300, shown in deployed and folded positions, respectively, in accordance with an embodiment of the present disclosure. FIG. 14 illustrates an exploded view of front sight assembly 200 as shown in FIG. 13*a*. The description provided above with respect to rear sight assembly 100 applies equally to front sight assembly 200, and the features of front sight assembly 200 are referenced in the figures using the same numbers as those referenced for rear assembly 100, except that the front sight assembly numbers are in the 200s (e.g., base 110 of rear sight assembly 100 is analogous to base 210 of front sight assembly 200, pivot pin 150 of rear sight assembly 100 is analogous to pivot pin 250 of front sight assembly 200, etc.). Therefore, only the differences between front sight assembly 200 and rear sight assembly 100 will be primarily discussed herein, for ease of description.

As can be seen in FIGS. 13*a-b* and 10, the only differences between front sight assembly 200 in this embodiment and rear sight assembly 100 (as previously described), is that front sight assembly 200 has a different arm 220, sight 230, and sight adjustment componentry (e.g., sight screw 240). However, arm 220 of front sight assembly 200, in this embodiment, is configured to fold, be aligned, interface with locking slots and detent slots, etc. as variously described above with reference to rear sight assembly 100. Note that although sight assembly 100 is sometimes referred to herein as a rear sight assembly and sight assembly 200 is sometimes referred to herein as a front sight assembly, sight assembly 100 is not intended to be limited for use with the rear of a firearm/firearm rail and sight assembly 200 is not intended to be limited for use with the front of a firearm/firearm rail, but are merely referred to as rear and front sight assemblies for ease of description. Also note that if sight assembly 200 is used in the front of a firearm, it may be configured to attach/mount to the barrel of the firearm, in some embodiments.

Figure 15B:
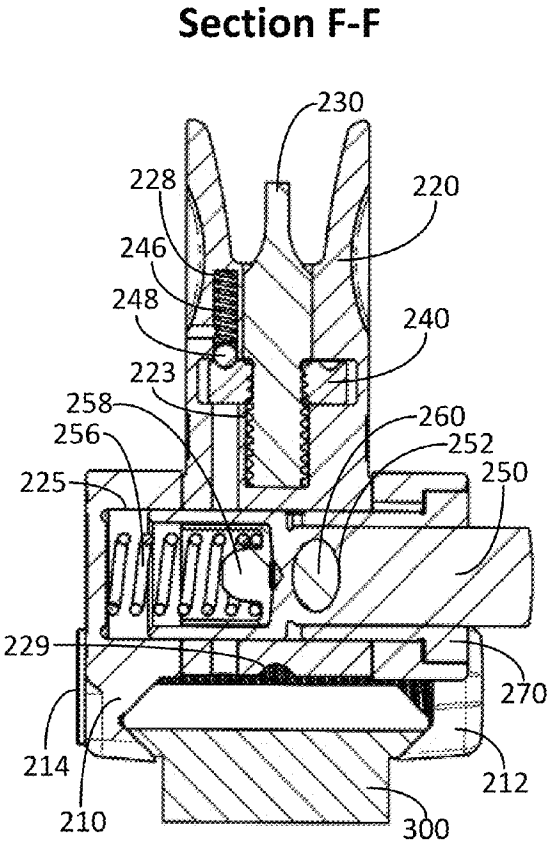
FIG. 15*b* illustrates a cross-sectional view along line F-F of the configuration shown in FIG. 15*a*.
Figure 15A:
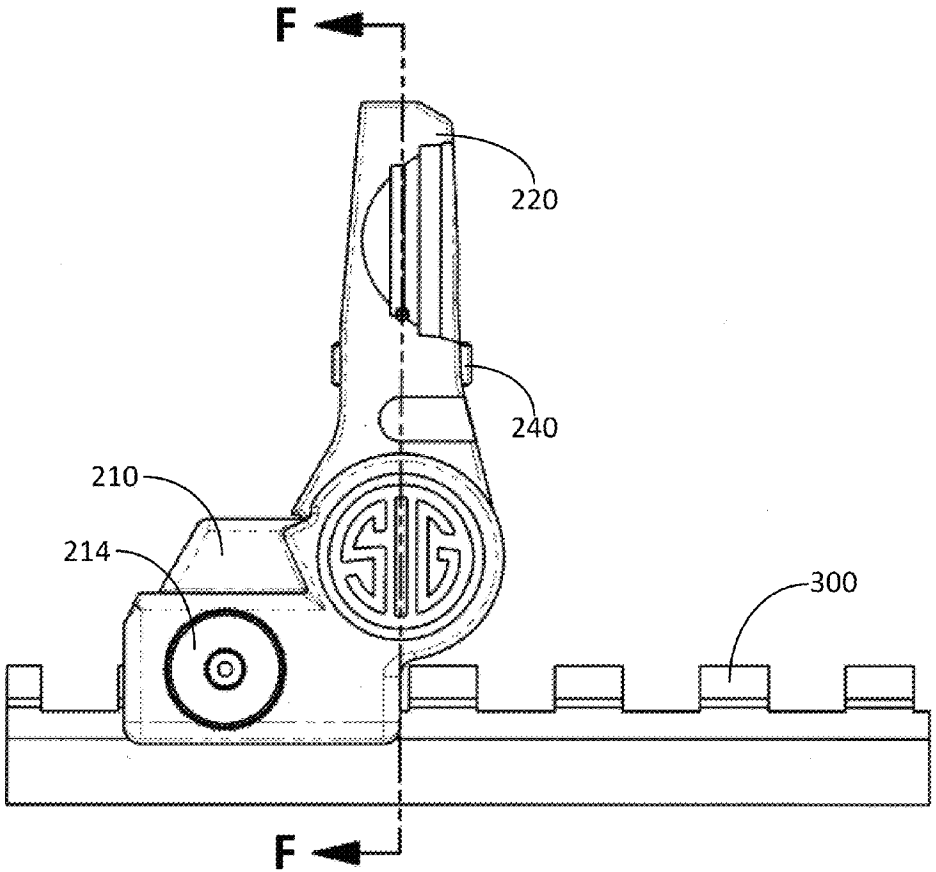
FIG. 15*a* illustrates a right planar view of the front sight assembly of FIG. 13*a*.
Figure 16B:
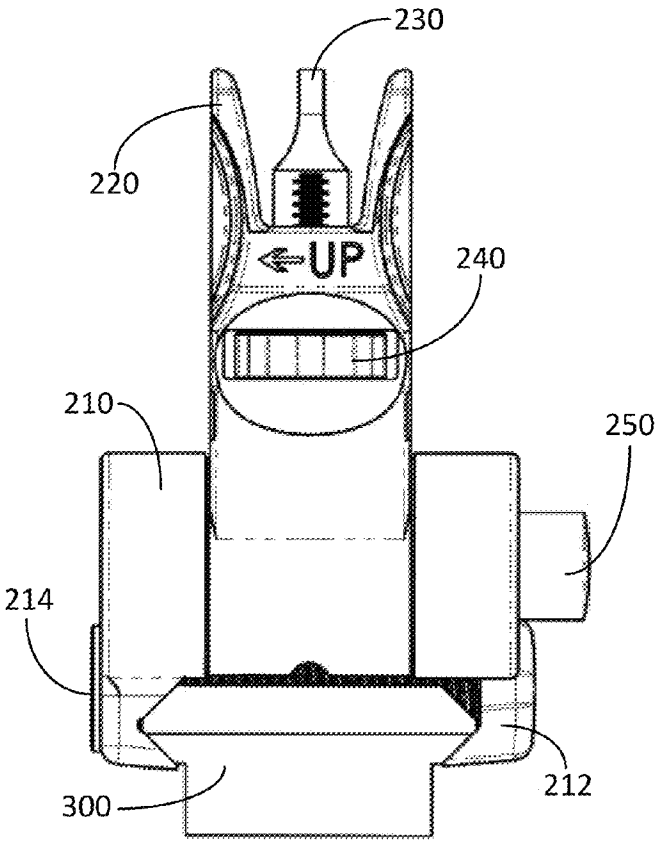
FIGS. 16*a-b* illustrate front planar views of the front sight assembly of FIG. 13*a*, showing multiple sight positions.
Figure 16A:
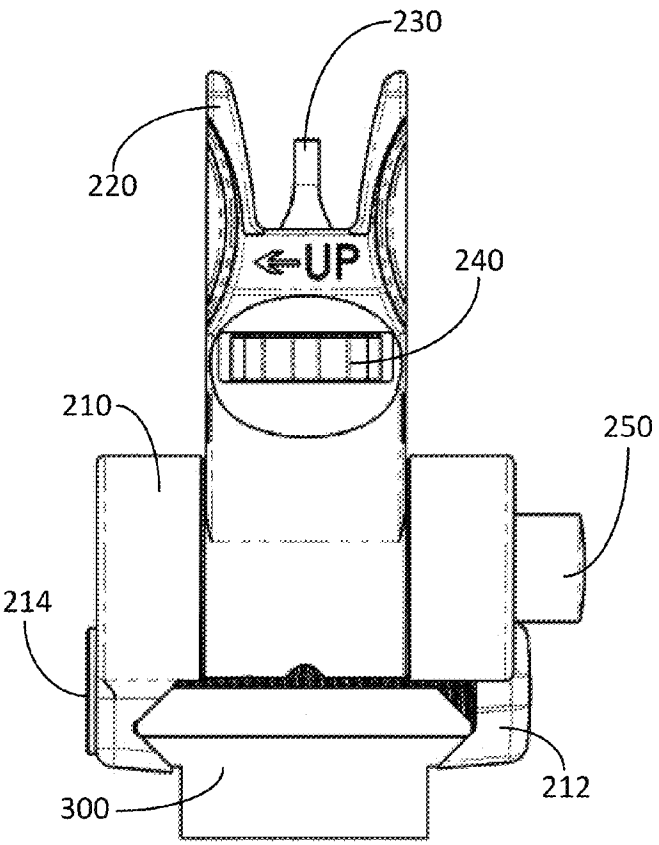

FIG. 15*a* illustrates a right planar view of front sight assembly 200 attached to firearm rail 300 and shown in a deployed position, in accordance with an embodiment of the present disclosure. FIG. 15*b* illustrates a cross-sectional view along line F-F of front sight assembly 200 attached to firearm rail 300 as shown in FIG. 15*a*. FIG. 16*a-b* illustrate front planar views of front sight assembly 200 showing multiple positions for sight 230, in accordance with an embodiment of the present disclosure. FIGS. 14 and 15*b* show that sight 230 can be attached to arm 220 by first inserting sight screw wheel 240 in screw slot 222 (in arm 220), such that hole 241 in sight screw wheel 240 and hole 221 in arm 220 align. Sight 230 can then be inserted into hole 221 and threaded through sight screw hole 241, until threads of sight 230 extend into bore 223 (e.g., as can be seen in FIG. 15*b*). Prior to assembling sight 230, in this embodiment, spring 246 and ball 248 can be inserted into bore 228 (indicated in FIG. 15*b*) in arm 220 to spring load sight screw wheel 240.

In this embodiment, sight screw wheel 240 can be rotated to adjust the vertical position of sight 230. In some instances, sight screw wheel 240 may include indentations (e.g., indicated as 242 in FIG. 14) in the area that ball 248 rotates over, such that tactile and/or aural feedback (e.g., one or more clicks) is provided when rotating wheel 240 to adjust the vertical position of sight 230. For example, one click of wheel 240 may be equal to ½ mm, or some other suitable height. In some instances, sight 230 and wheel 240 may have a roller screw configuration, such that rotating wheel 240 causes sight 230 to move in a substantially linear motion. FIG. 16*a* shows sight 230 in a first, lower position and FIG. 16*b* shows sight 230 in a second, higher position (e.g., after a user rotated wheel 240 to achieve the desired higher position shown). In this embodiment, sight 230 is a post having a tritium lamp, and in instances where adjusting sight 230 causes the sight 230 to only move in a liner motion (and not rotate), the tritium lamp (or other lamp or light source associated with sight 230) can advantageously stay positioned in front of the shooter's eye at all adjustment heights. In other embodiments, sight 230 may include other sights/reticles/apertures, such as a ring, a bead, a crosshair, or a notch (e.g., a U or V-notch). Any suitable configuration may be used for sight assembly 200, and the example sight 230 having a post and tritium lamp as shown is provided for illustrative purposes and is not intended to limit the present disclosure, unless otherwise indicated.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A firearm sight assembly comprising:
a base configured to attach to a firearm rail;
an arm pivotally coupled to the base using a spring-loaded pivot pin;
a sight attached to the arm;
a linking pin connecting the pivot pin and the arm; and
a bushing non-permanently attached to the base, wherein the bushing includes at least one slot;
wherein the spring-loaded pivot pin forces the linking pin into the at least one bushing slot when the arm is in one of a deployed and folded position.

2. The assembly of claim 1, wherein the at least one bushing slot is one of a locking slot and a detent slot.

3. The assembly of claim 1, wherein the bushing includes four slots, each separated by approximately ninety degrees, the four slots comprise the following order: a locking slot, a locking slot, a detent slot, a detent slot.

4. The assembly of claim 3, wherein the bushing can be depressed and rotated to set the desired slot selections for the deployed and folded positions.

5. The assembly of claim 1, wherein the at least one slot is one of a substantially U-shaped slot and a substantially V-shaped slot.

6. The assembly of claim 1, wherein the spring-loaded pivot pin can be depressed to remove the linking pin from the at least one bushing slot.

7. The assembly of claim 1, wherein the sight position can be adjusted relative to the arm.

8. The assembly of claim 1, wherein the sight includes at least two blades, each blade including an aperture and each blade extending no farther than the arm.

9. The assembly of claim 1, further comprising a sight screw wheel attached to the sight, wherein the sight position can be adjusted by rotating the sight screw wheel.

10. The assembly of claim 9, wherein the sight screw wheel is countersunk in the arm.

11. The assembly of claim 1, further comprising a ball detent located at least partially in the base, the ball detent configured to horizontally align the arm relative to the base.

12. The assembly of claim 1, further comprising a ball detent located at least partially in the arm, the ball detent configured to apply pressure to the sight.

13. The assembly of claim 1, wherein a longitudinal axis of the linking pin intersects a rotational axis of the pivot pin.

14. The assembly of claim 1, wherein the linking pin is integral with the pivot pin.

15. A sight assembly comprising:
a base;
an arm pivotally coupled to the base using a pivot pin, wherein the arm includes a sight;
a linking pin connecting the pivot pin and the arm; and
a bushing non-permanently coupled with the base, wherein the bushing includes a substantially U-shaped locking slot configured to substantially prevent rotation of the linking pin relative to the bushing and a substantially V-shaped detent slot configured to apply some resistance against rotation of the linking pin relative to the bushing.

16. The assembly of claim 15, wherein the base is configured to attach to a firearm.

17. The assembly of claim 15, wherein the bushing can be depressed and rotated to set a desired slot selection for when the arm is in one of a deployed and folded position.

18. The assembly of claim 15, further comprising a spring configured to directly or indirectly force the linking pin into the at least one slot.

19. A firearm sight assembly comprising:
a base configured to attach to a firearm rail;
an arm pivotally coupled to the base using a spring-loaded pivot pin;
a sight attached to the arm using a sight screw, the sight configured to be adjusted by rotating at least one of the sight screw and a wheel rotationally coupled to the sight screw;
a linking pin connecting the pivot pin and the arm; and
a bushing non-permanently attached to the base, wherein the bushing includes at least two slots;
wherein the spring-loaded pivot pin forces the linking pin into one of the at least two bushing slots.

20. The assembly of claim 19, wherein the at least two slots include at least one of a substantially U-shaped slot configured to substantially prevent rotation of the linking pin relative to the busing and a substantially V-shaped slot configured to apply some resistance against rotation of the linking pin relative to the bushing.

* * * * *